US008091890B2

(12) United States Patent
Yanagishita

(10) Patent No.: US 8,091,890 B2
(45) Date of Patent: Jan. 10, 2012

(54) MEDIUM FEEDING DEVICE AND RECORDING APPARATUS WITH SEPARATED REVERSE DIRECTION FEED DRIVING ROLLER

(75) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 387 days.

(21) Appl. No.: 12/473,393

(22) Filed: May 28, 2009

(65) Prior Publication Data

US 2009/0295067 A1 Dec. 3, 2009

(30) Foreign Application Priority Data

May 29, 2008 (JP) ..... 2008-141097

(51) Int. Cl.
*B65H 5/06* (2006.01)

(52) U.S. Cl. ..... 271/273; 271/10.11; 271/10.12; 271/228; 271/242; 271/277

(58) Field of Classification Search ..... 271/277, 271/265.02, 228, 242, 273, 10.12, 10.11
See application file for complete search history.

(56) References Cited

U.S. PATENT DOCUMENTS 4,436,298 A * 3/1984 Donner et al. ..... 271/10.12
7,726,648 B2 * 6/2010 Tamura et al. ..... 271/273

FOREIGN PATENT DOCUMENTS

JP 11-106083 4/1999
JP 11106083 A * 4/1999
JP 3351509 B 11/2002

* cited by examiner

*Primary Examiner* — Gerald McClain
(74) *Attorney, Agent, or Firm* — Workman Nydegger

(57) ABSTRACT

A medium feeding device includes a feed roller pair, a transport roller, a medium guiding path section, and a controller. The feed roller pair includes a feed driving roller driven by power and a feed driven roller to be rotationally driven, and feeds a medium to be fed toward the downstream side in a feed direction. The feed driving roller and the feed driven roller are separated from each other. The transport roller pair transports the medium, which is fed by the feed roller pair, toward the downstream side in the feed direction. The transport roller pair includes a transport driving roller that is disposed on the downstream side of the feed roller pair in the feed direction and is driven by power and a transport driven roller that is rotationally driven.

7 Claims, 17 Drawing Sheets

MEDIUM FEEDING DEVICE AND RECORDING APPARATUS WITH SEPARATED REVERSE DIRECTION FEED DRIVING ROLLER

The present application claims priority from Japanese Patent Application No. 2008-141097, filed on May 29, 2008, the disclosure of which is incorporated herein by reference in its entirety.

BACKGROUND

1. Technical Field

The present invention relates to a medium feeding device and a recording apparatus including the medium feeding device. The medium feeding device includes a feed roller pair, a transport roller pair, and a medium guiding path section. The feed roller pair includes a feed driving roller driven by power and a feed driven roller to be rotationally driven, and feeds a medium to be fed toward the downstream side in a feed direction. The transport roller pair transports the medium, which is fed by the feed roller pair, toward the downstream side in the feed direction, and includes a transport driving roller that is disposed on the downstream side of the feed roller pair in the feed direction and is driven by power and a transport driven roller that is rotationally driven. The medium guiding path section guides the fed medium up to the transport roller pair.

In the invention, examples of the recording apparatus include an ink jet printer, a wire dot printer, a laser printer, a line printer, a copier, and a facsimile.

2. Related Art

In the past, as disclosed in Japanese Patent No. 3351509, a feeding device provided in a recording apparatus was provided with a pickup roller, a guiding path section, a feed roller pair, and a transport roller pair. The pickup roller of them was provided to pick up a placed paper sheet that served as a medium to be fed, and to feed the paper sheet toward the downstream side in a feed direction. Further, the guiding path section was provided to form a feed path and to guide the paper sheet to be fed.

Furthermore, the feed roller pair included a feed driving roller that was driven by power, and a feed driven roller that was rotationally driven. The feed roller pair was provided to further feed the picked paper sheet toward the downstream side in the feed direction. The transport roller pair included a transport driving roller that was driven by power, and a transport driven roller that was rotationally driven. Further, the transport roller pair was provided to further feed the paper sheet, which was fed by the feed roller pair, toward the downstream side in the feed direction.

FIG. 17 is a side view showing the schematic inner configuration of a recording apparatus in the related art.

As shown in FIG. 17, a feed device 201, which was provided in a recording apparatus 200 in the related art, included a pickup roller 203, a guiding path section 202, a feed roller pair 205, and a transport roller pair 208. The pickup roller 203 was provided to pick up a placed paper sheet and to feed the paper sheet toward the downstream side in the feed direction. Further, the guiding path section 202 was provided to form a feed path and to guide the picked paper sheet up to the transport roller pair 208.

Furthermore, the feed roller pair 205 included a feed driving roller 206 that was driven by power, and a feed driven roller 207 that was rotationally driven. The feed roller pair was provided to further feed the picked paper sheet toward the downstream side in the feed direction. The transport roller pair 208 was formed to transport the paper sheet, which was fed by the feed roller pair 205, to a recording device 209 that was provided further downstream in the feed direction.

First, the picked paper sheet entered a retard roller 204 that requires a predetermined load when being rotated. If paper sheets are doubly fed, so-called retard-separation is performed. Further, only the uppermost paper sheet at the feed driving roller 206 is fed to the transport roller pair 208 by the feed roller pair 205. First, the front end of the paper sheet is nipped by the transport roller pair 208. This is so-called initial biting. Then, the transport roller pair 208 is rotated in a reverse direction, so that the front end of the paper sheet is moved toward the upstream side of a nip point of the transport roller pair 208 in the feed direction. This is a so-called discharge operation.

In this case, the feed roller pair 205 is at a stop. Accordingly, the paper sheet may be deflected between the feed roller pair 205 and the transport roller pair 208 as shown in FIG. 17. The attitude of one end 210 of the paper sheet in a width direction X of the paper sheet is shown by a solid line shown in FIG. 17. Meanwhile, the attitude of the other end 211 of the paper sheet in the width direction X is shown by a chain line. As the attitude of the front end of the paper sheet during the initial biting is significantly inclined with respect to a nip line of the transport roller pair 208, the difference between the attitude of one end 210 of the paper sheet and the attitude of the other end 211 of the paper sheet is increased.

While the attitude of the front end of the paper sheet follows the nip line of the transport roller pair 208, the transport roller pair 208 is rotated in a normal direction so that the front end of the paper sheet is nipped by the transport roller pair 208 again. Accordingly, skew correction was performed in the manner of so-called biting discharge.

After that, the transport roller pair 208 transported the paper sheet to the recording device 209, and recording was performed on the paper sheet by the recording device 209. In this case, the retard roller 204 and the feed driven roller 207 were separated from the feed driving roller 206. Accordingly, it might be possible to reduce so-called back tension that was generated while the paper sheet was transported by the transport roller pair 208.

However, even though the retard roller 204 and the feed driven roller 207 were separated from the feed driving roller 206, it was not enough to remove the difference between the deflection of one end 210 of the paper sheet in the width direction X and the deflection of the other end 211 of the paper sheet in the width direction X. Since the paper sheet was deflected between the feed roller pair 205 and the transport roller pair 208, the paper sheet at the transport roller pair 208 was pushed to the downstream side in the feed direction. Accordingly, there is a concern that the difference is generated between the transport distance of one end 210 of the paper sheet in the width direction X and the transport distance of the other end 211 of the paper sheet in the width direction X due to the difference between the deflections. As a result, there is a concern that skew newly occurs while the paper sheet is transported after the skew correction.

In particular, if the guiding path of the paper sheet between picking-up and the transport roller pair 208 is curved in side view, a trouble is apt to be generated in the case of a paper sheet of which the size is A3 or more.

SUMMARY

An advantage of some aspects of the invention is to provide a medium feeding device that can stabilize the attitude of a medium being transported and transport the medium, and a recording apparatus including the medium feeding device.

According to a first aspect of the invention, a medium feeding device includes a feed roller pair, a transport roller pair, a medium guiding path section, and a controller. The feed roller pair includes a feed driving roller driven by power and a feed driven roller to be rotationally driven, and feeds a medium to be fed toward the downstream side in a feed direction. The feed driving roller and the feed driven roller are separated from each other. The transport roller pair transports the medium, which is fed by the feed roller pair, toward the downstream side in the feed direction. The transport roller pair includes a transport driving roller that is disposed on the downstream side of the feed roller pair in the feed direction and is driven by power, and a transport driven roller that is rotationally driven. The medium guiding path section guides the fed medium up to the transport roller pair. The controller makes a front end of the medium, which is a downstream end in the feed direction, be nipped by the transport roller pair by rotationally driving the transport driving roller in a normal direction at the time of skew correction. The controller makes the front end of the medium follow a nip line of the transport roller pair by rotationally driving the transport driving roller in a reverse direction, and makes the front end of the medium be nipped by the transport roller pair by rotationally driving the transport driving roller and the feed driving roller in the normal direction. Then, the controller makes the feed driven roller and the feed driving roller be separated from each other while the transport driving roller is stopped, and rotationally drives the feed driving roller in the reverse direction.

According to the first aspect of the invention, the medium feeding device includes the controller. Accordingly, the medium feeding device can make a front end of the medium, which is a downstream end in the feed direction, be nipped by the transport roller pair by rotationally driving the transport driving roller in a normal direction at the time of skew correction. Further, the medium feeding device can make the front end of the medium follow a nip line of the transport roller pair by rotationally driving the transport driving roller in a reverse direction, and make the front end of the medium be nipped by the transport roller pair by rotationally driving the transport driving roller and the feed driving roller in the normal direction. Then, the medium feeding device can make the feed driven roller and the feed driving roller be separated from each other while the transport driving roller is stopped, and rotationally drive the feed driving roller in the reverse direction.

As a result, it may be possible to remove the difference between the left and right deflections of the medium to be fed, which are generated between the feed roller pair and the transport roller pair in the feed direction. Further, it may be possible to prevent the occurrence of so-called accumulated skew that is caused by the difference between the left and right deflections of the medium during transport thereafter. That is, it may be possible to stabilize the attitude of the medium to be fed in the feed direction during transport by removing the difference between the forces that push the medium toward the downstream side in the feed direction and are caused by the difference between the left and right deflections.

Further, the feed driven roller and the feed driving roller are separated form each other. Accordingly, a reverse feed force, which is applied to the medium toward the upstream side in the feed direction, is small as compared to when the feed driven roller and the feed driving roller are separated form each other. In addition, it may be possible to apply the reverse feed force to the medium while slip easily occurs between the feed driving roller and the medium to be fed. Accordingly, since the medium to be fed is pulled toward the upstream side in the feed direction, it may be possible to reduce the damage such as an injury, which is applied from the transport roller pair to the nipped portion of the front end of the medium to be fed, as much as possible. That is, there is no concern that the portion of the medium nipped by the transport roller pair is damaged.

According to a second aspect of the invention, in the first aspect, the feed driving roller may be a polished rubber roller, and rubber scales may correspond to inverse scales when the feed driving roller is rotationally driven in the reverse direction.

According to the second aspect of the invention, in addition to the same advantages as the first aspect, the feed driving roller may be a polished rubber roller, and rubber scales may correspond to inverse scales when the feed driving roller is rotationally driven in the reverse direction.

In this case, if a rubber roller is polished, rubber scales are generally formed.

Further, in general, a friction coefficient in the case of an inverse scale of a polished rubber roller is extremely smaller than that of a normal scale.

Accordingly, it may be possible to further reduce the reverse feed force. Further, when the feed driving roller is rotationally driven in a reverse direction, it may be possible to remove the difference between the left and right deflections while the feed driving roller actively slides on the medium to be fed. As a result, it may be possible to more effectively reduce the damage such as an injury that is applied from the transport roller pair to the nipped portion of the front end of the medium to be fed.

According to a third aspect of the invention, in the first or second aspect, the medium guiding path section may form a U-shaped path up to the transport roller pair in side view.

According to the third aspect, in addition to the same advantages as the first or second aspect, the medium guiding path section may form a U-shaped path up to the transport roller pair in side view.

In this case, in particular, if the path between the pickup roller and the transport roller pair is formed in a U shape, the attitude of the medium to be fed tends to be strongly held by the medium guiding path section. That is, if there is difference between the left and right deflections, there is a concern that it may not be possible to remove the difference between the left and right deflections even if the feed driven roller is separated from the feed driving roller.

In this case, it may be particularly effective to rotationally drive the feed driving roller in the reverse direction.

In addition, if the size of the medium to be fed is A3 or more, the medium to be fed is positioned over the U-shaped portion of the path. Accordingly, the attitude of the medium to be fed tends to be more strongly held. In this case, it may be particularly effective to rotationally drive the feed driving roller in the reverse direction.

According to a fourth aspect of the invention, in any one of the first to third aspects, the medium feeding device may further include a pickup roller that picks up a placed medium and feeds the medium toward the downstream side in the feed direction, and the pickup roller may be separated from the placed medium when the feed driven roller and the feed driving roller are separated from each other.

According to the fourth aspect, in addition to the same advantages as any one of the first to third aspects, the pickup roller may be separated from the placed medium when the feed driven roller and the feed driving roller are separated from each other. Accordingly, when the difference between the left and right deflections is removed at the time of skew correction and the attitude of the rear end of the medium, which is the upstream end in the feed direction, is corrected, there is no concern that the pickup roller obstructs the correction of the attitude. As a result, even though the size of the medium to be fed is relatively large, it may be possible to more reliably remove the difference between the left and right deflections and to correct the attitude of the rear end of the medium to be fed.

According to a fifth aspect of the invention, in any one of the first to fourth aspects, the medium feeding device may further include a pair of medium attitude detectors that is turned on and detects the attitude of the medium if levers are in contact with the medium between the feed roller pair and the transport roller pair in the feed direction and at positions that face one and the other ends of the medium in a width direction of the medium. The controller may make the feed driven roller and the feed driving roller be separated from each other and rotationally drives the feed driving roller in the reverse direction, when one of the pair of the medium attitude detectors is turned on. The controller may stop the reverse rotation driving of the feed driving roller when the turning-on or off of one medium attitude detectors is switched to be the same as the turning-on or off of the other medium attitude detector.

According to the fifth aspect, in addition to the same advantages as any one of the first to fourth aspects, the medium feeding device may further include a pair of medium attitude detectors. Further, the controller may make the feed driven roller and the feed driving roller be separated from each other and rotationally drive the feed driving roller in the reverse direction, when one of the pair of the medium attitude detectors is turned on. Then, the controller may stop the reverse rotation driving of the feed driving roller when the turning-on or off of one medium attitude detectors is switched to be the same as the turning-on or off of the other medium attitude detector.

Accordingly, it may be possible to reliably remove the difference between the left and right deflections. That is, until the medium attitude detector, which in a state where the left and right deflections are removed, is turned off, the feed driving roller is rotationally driven in the reverse direction.

Further, if there is no difference between the left and right deflections, both of the pair of medium attitude detectors is turned on or off. In this case, it is determined that there is no difference between the left and right deflections, and the feed driving roller may not be rotationally driven in the reverse direction. That is, it is determined whether there is difference between the left and right deflections, and the feed driving roller is rotationally driven in the reverse direction only in a certain case, so that it may be possible to remove the difference between the left and right deflections.

According to a sixth aspect of the invention, in any one of the first to fifth aspects, the feed driving roller may be provided so as to approach or be separated from the feed driven roller by a planetary gear mechanism, and the feed driving roller may be rotationally driven in the reverse direction and separated from the feed driven roller.

According to the sixth aspect, in addition to the same advantages as any one of the first to fifth aspects, the feed driving roller may be provided so as to approach or be separated from the feed driven roller by a planetary gear mechanism, and the feed driving roller may be rotationally driven in the reverse direction and separated from the feed driven roller. Accordingly, a timing to begin to be separated may be equal to a timing to begin to rotationally drive the feed driving roller in the reverse direction. As a result, it may be possible to more reliably prevent an injury from being generated at the nipped portion.

Further, since the feed driving roller may be separated from the feed driven roller along the U-shaped curve portion and a reverse feed force may be appropriately generated toward the upstream side in the feed direction, it may be possible to more reliably remove the difference between the deflections.

Furthermore, the power, which rotationally drives the feed driving roller in the reverse direction, may be easily used as the power, which makes the feed driving roller approach or be separated from the feed driven roller, by the planetary gear mechanism.

According to a seventh aspect of the invention, a recording apparatus includes a feed device that picks up a placed recording medium and feeds the recording medium toward the downstream side in a feed direction, and a recording device performs recording on the fed recording medium by a recording head. The feed device may include the medium feeding device according to any one of the first to sixth aspects.

According to the seventh aspect, the feed device may include the medium feeding device according to any one of the first to sixth aspects. Accordingly, in the recording apparatus, it may be possible to obtain the same advantages as any one of the first to sixth aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to drawings.

Figure 1:
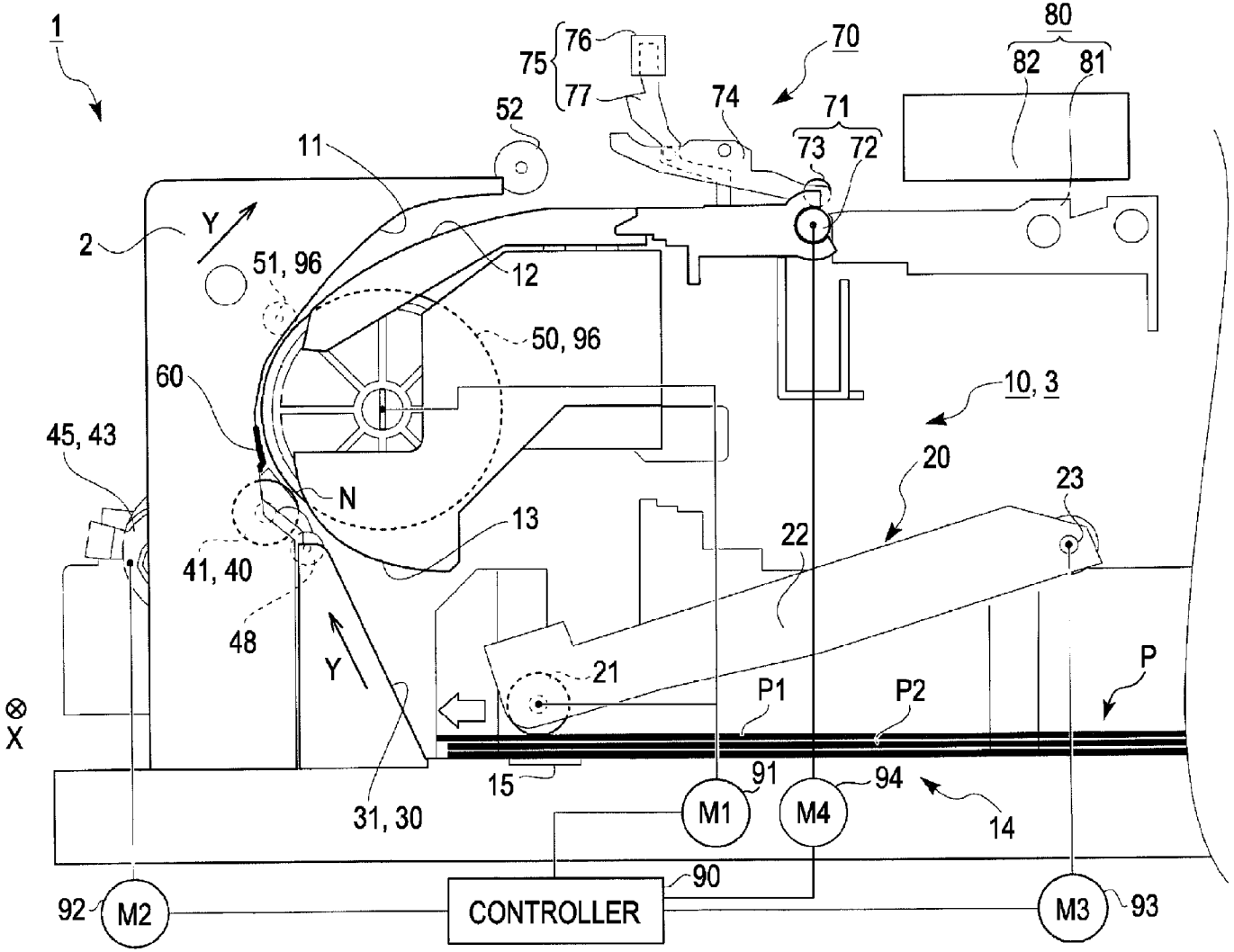
FIG. 1 is a side view illustrating an operation at the time of pickup in a printer according to an embodiment of the invention.

FIG. 1 is a side view illustrating an operation at the time of pickup in an ink jet printer (hereinafter, referred to as a "printer") 1 that is an example of a "recording apparatus" or a "liquid ejecting apparatus".

In this case, the liquid ejecting apparatus is not limited to recording apparatuses an ink jet type recording apparatus (which performs recording on a recording material by ejecting ink onto the recording material such as a recording sheet from a recording head serving as a liquid ejecting head), a copier, and a facsimile. Further, the liquid ejecting apparatus may include the following apparatus. That is, this apparatus attaches liquid on a material, onto which liquid is ejected, by ejecting the liquid, which corresponds to specific application and is used instead of ink, onto the material, which corresponds to the recording material and onto which liquid is ejected, from a liquid ejecting head corresponding to the above-mentioned recording head.

Further, examples of the liquid ejecting head may include a color material ejecting head that is used to manufacture a color filter of a liquid crystal display or the like, a color material ejecting head that is used to manufacture a color filter of a liquid crystal display or the like, an electrode material (conductive paste) ejecting head that is used to form electrodes of an organic light emitting display or a surface-emitting display (FED: field emission display), a bioorganic material ejecting head that is used to manufacture a biochip, and a sample ejecting head that ejects a sample as a precision pipette, other than the above-mentioned recording head.

As shown in FIG. 1, a printer 1 includes a feed device 3 that serves as a feeder for feeding paper sheets P, a recording device 80, and a discharge device (not shown). The feed device 3 of these devices includes a feeding unit 10 and a transport unit 70. Further, the feeding unit 10 includes a pickup section 20, a preliminary separation section 30, and a main separation section 40. The pickup section 20 is provided so as to pick up paper sheets P placed in a cassette 14 and feed the paper sheets to the downstream side in a feed direction.

Specifically, the pickup section includes a pickup roller 21 that is driven by the power of a feeding motor 91 (which is an example of a driving source), and an arm 22 that swings about an arm shaft 23 for holding the pickup roller 21. Further, the pickup roller 21 is pushed so as to approach the paper sheet P by a pushing member (not shown). Furthermore, the arm 22 swings by a pickup retreating member (not shown), and is provided so as to be separated from the paper sheet P on which the pickup roller 21 is placed. This is a so-called pickup release operation.

The preliminary separation section 30 includes a bank separation member 31 that perform so-called bank separation. The operation of the preliminary separation section will be described below.

The main separation section 40 is provided on the downstream side of the preliminary separation section 30 in the feed direction. The main separation section 40 includes a so-called retard roller 41 that is rotated by a predetermined load. The retard roller 41 is provided so as to make a pair with an intermediate driving roller 50 that is driven by the power of the feeding motor 91. Further, the retard roller 41 is provided so as to approach or be separated from the intermediate driving roller 50 by a swing mechanism 43 (see FIG. 5). Specifically, the swing mechanism 43 is adapted to hold the retard roller 41 by a retard holder 42 (see FIG. 5) and to swing about a pivot 46 (see FIG. 5).

Further, one end of a push spring 47 (see FIG. 5) is engaged with a base body 2, and the other end thereof is engaged with a free end of the retard holder 42. Accordingly, the retard roller 41 may be pushed so as to approach the intermediate driving roller 50. The swing mechanism 43 includes a cam 45, which is driven by the power of a separation motor 92, as a member that separates the retard roller 41 from the intermediate driving roller 50 against the pushing force of the push spring 47. The cam 45 is engaged with a convex portion (not shown) of the retard holder 42, thereby forming a groove cam mechanism. The cam is provided to separate the retard roller 41 from the intermediate driving roller 50 by the retard holder 42.

Further, a first assist roller 48 to be rotationally driven is provided between the bank separation member 31 and the retard roller 41. The first assist roller 48 is provided to smoothly guide the front end of the paper sheet P, which has passed the bank separation member 31, to a nip point N between the retard roller 41 and the intermediate driving roller 50.

Furthermore, sheet front end regulating ribs 60 and 60 to be described below are provided on the downstream side of the nip point N, which is formed between the retard roller 41 and the intermediate driving roller 50, in the feed direction.

In addition, a second assist roller 51, which is rotatably held by the base body 2 and in contact with the intermediate driving roller 50 is provided on the downstream in the feed direction. The second assist roller 51 forms a feed roller pair 96 with the intermediate driving roller 50. Further, a third assist roller 52 is rotatably provided on the downstream side in the feed direction.

Herein, a feed path of the paper sheet P is formed in a U shape from the pickup section 20 to the transport unit 70. Specifically, the U-shaped feed path is formed by a U-shaped outer sheet guide portion 11 that guides the paper sheet P on the outside of the U shape, an inner sheet guide portion 12 that guides the paper sheet on the inside, the bank separation member 31, and a winding prevention portion 13 to be described below.

Accordingly, it may be possible to reduce frictional resistance, which is generated between the paper sheet P and the U-shaped outer sheet guide portion 11 of the base body 2, by the first to third assist rollers 48 to 52. Therefore, it may be possible to more smoothly feed the paper sheet P to the transport unit 70 that is provided on the downstream side in the feed direction.

The transport unit 70 includes a transport roller pair 71 that transports the paper sheet P. The transport roller pair 71 includes a transport driving roller 72 that is driven by the power of the transport motor 94, and a transport driven roller 73 to be rotationally driven. The transport driven roller 73 of these rollers is rotatably held by a driven roller holder 74.

Further, the driven roller holder 74 presses the transport driven roller 73 against the transport driving roller 72 by a pushing member (not shown). Furthermore, a paper sheet detector 75, which detects whether the paper sheet P exists, is provided near the upstream side of the transport roller pair 71 in the feed direction Y. Specifically, the paper sheet detector 75 includes a swingable paper sheet detecting lever 77 and a sensor 76. Furthermore, when one end of the paper sheet detecting lever 77 is bumped against the paper sheet P, the paper sheet detecting lever swings, so that the other end of the paper sheet detecting lever 77 is deviated from a gap between a light-emitting part and a light-receiving part (not shown) of the sensor 76. As a result, the paper sheet detector is in an ON state.

Meanwhile, the transport unit 70 is provided so as to transport the paper sheet P to the recording device 80 that is provided on the downstream side in the feed direction.

In addition, the recording device 80 includes a recording head 82 that performs recording by ejecting ink onto the paper sheet P, and a platen 81 that faces the recording head 82 and supports the paper sheet P from below.

After that, a recorded paper sheet P is discharged to a discharge tray (not shown), which is provided at the front portion of the printer 1, by a discharge roller of a discharge device (not shown).

Subsequently, a paper sheet feeding operation will be described in more detail.

As shown in FIG. 1, when the uppermost paper sheet P1 is picked up by the pickup roller 21 placed on the cassette 14, a controller 90 makes the arm 22 swing so that the pickup roller 21 is in contact with the uppermost paper sheet P1. Then, an arm motor 93 is driven, so that the pickup roller 21 is rotated clockwise in FIG. 1.

In this case, the pickup roller 21 is pushed so as to approach the paper sheet P by a pushing member (not shown). Accordingly, a frictional force is generated between the pickup roller 21 and the uppermost paper sheet P1, thereby generating a feed force that is a force for feeding the paper sheet toward the downstream side in the feed direction. Further, the uppermost paper sheet P1 begins to be moved toward the downstream side in the feed direction by the feed force. That is, the paper sheet is picked up and fed toward the downstream side.

Meanwhile, assuming that a friction coefficient between the pickup roller 21 and the uppermost paper sheet P1 is denoted by $\mu 1$, a friction coefficient between the paper sheets P is denoted by $\mu 2$, and a friction coefficient between the paper sheet P and a pad 15, which is positioned on the base body to face the pickup roller 21, is denoted by $\mu 3$, a relationship of "friction coefficient $\mu 1$>friction coefficient $\mu 3$>friction coefficient $\mu 2$" is satisfied. Accordingly, it may be possible to reduce a concern that overlapping several paper sheets P are fed, that is, so-called double feeding occurs.

When the paper sheet is picked up, the retard roller 41 has approached the intermediate driving roller 50.

Figure 2:
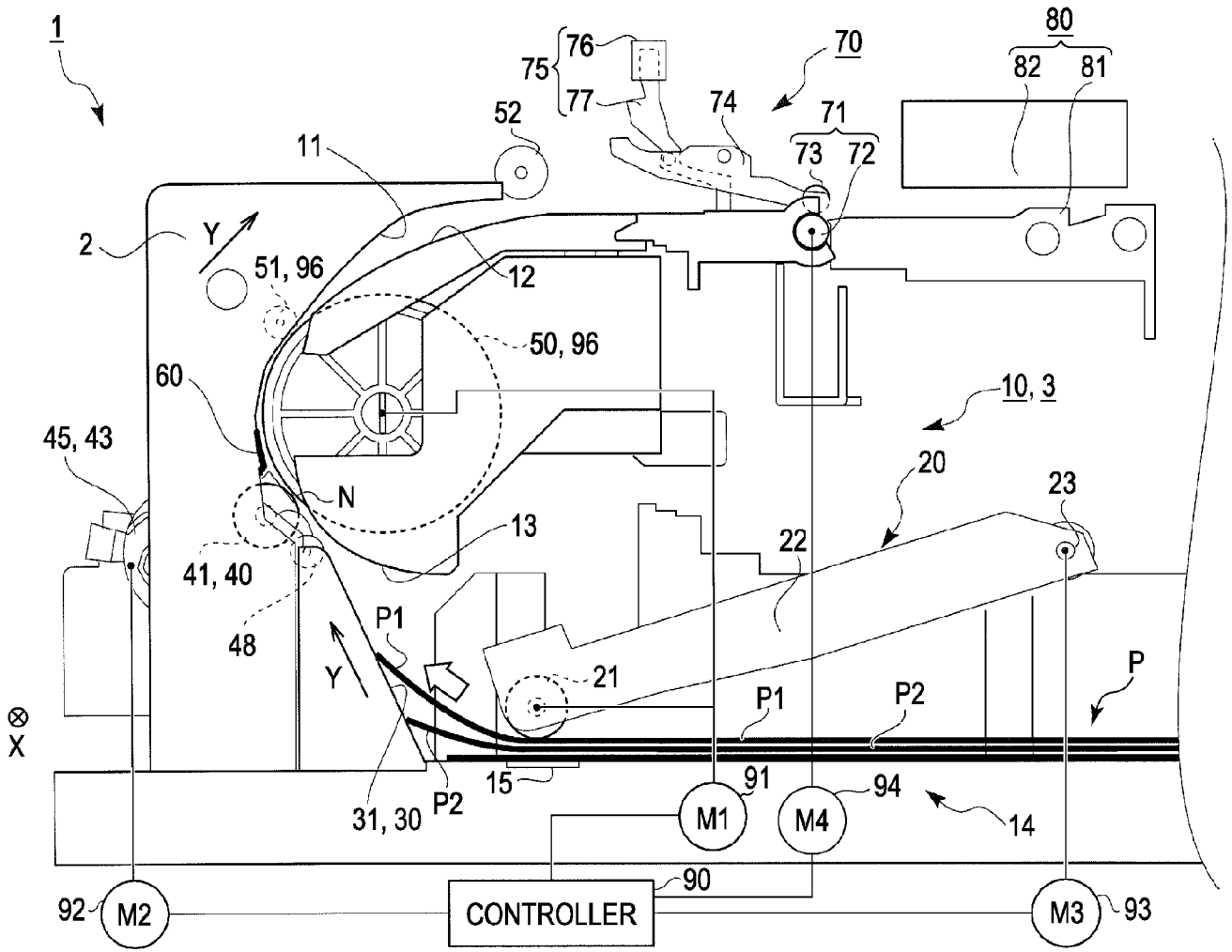
FIG. 2 is a side view illustrating an operation at the time of bank-separation in the printer according to the embodiment of the invention.

FIG. 2 is a side view illustrating an operation at the time of bank-separation in the printer according to the embodiment of the invention.

As shown in FIG. 2, the paper sheet P, which is picked up by the pickup roller 21, is fed toward the downstream side in the feed direction. Further, the fed paper sheet P enters the bank separation member 31 of the preliminary separation section 30.

Meanwhile, there is a concern that a feed force is also generated at the following paper sheet P2 by the pickup roller 21 due to the friction coefficient $\mu 2$ between the uppermost paper sheet P1 and the succeeding paper sheet P2 and a pushing force pushing the pickup roller 21.

In this case, not only the uppermost paper sheet P1 but also the following paper sheet P2 are fed toward the downstream side in the feed direction by the pickup roller 21.

Then, the paper sheet P enters the bank separation member 31, which is provided at an angle where the attitude of the front end of the paper sheet P is changed, in order to separate the doubly-fed following paper sheet P2 from the uppermost paper sheet P1. Further, the front end of the paper sheet P is bumped against the bank separation member 31, so that the following paper sheet P2 may be stopped. Furthermore, a gap may be formed between the uppermost paper sheet P1 and the following paper sheet P2. Accordingly, it may be possible to separate the doubly-fed following paper sheet P2 from the uppermost paper sheet P1.

Figure 3:
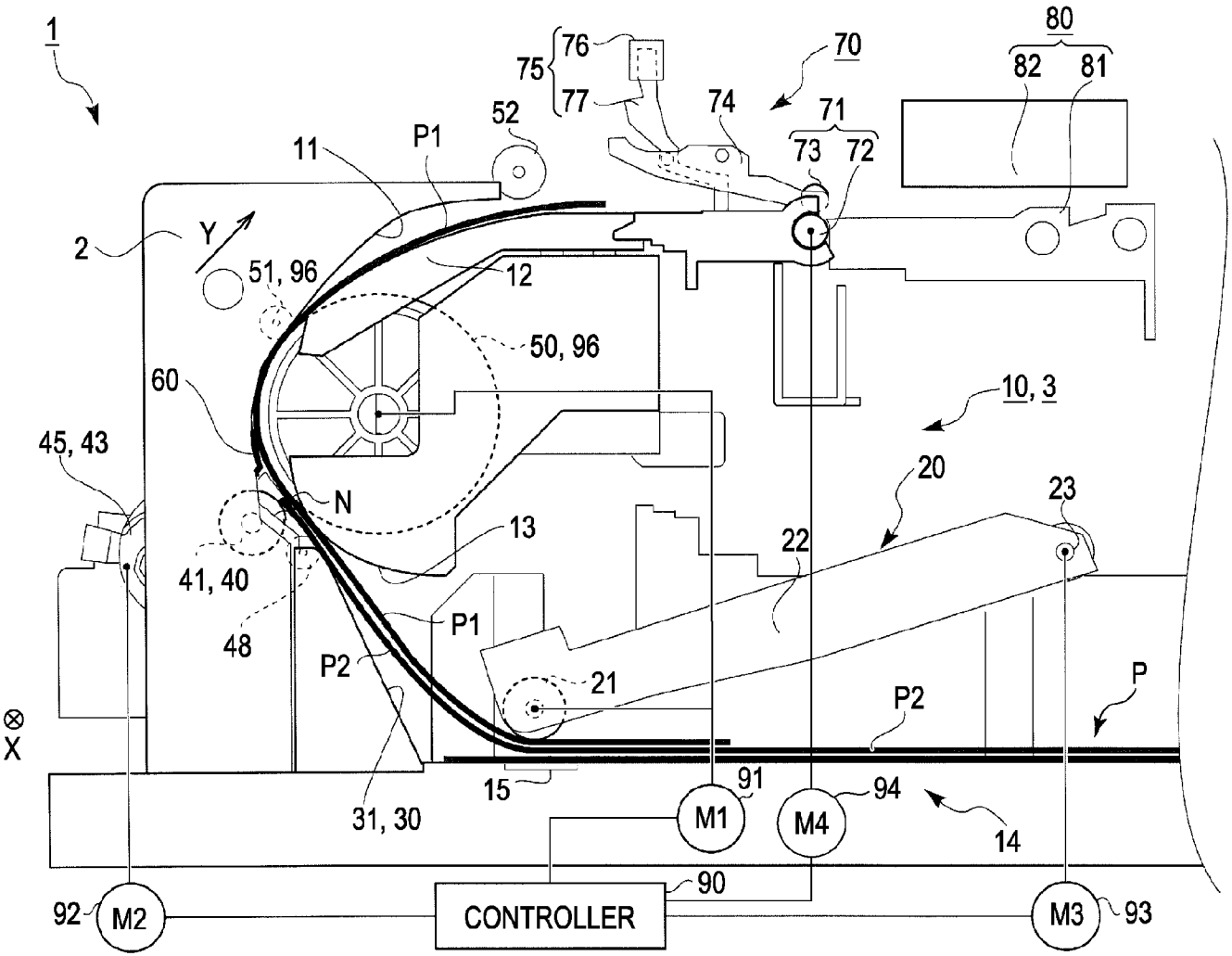
FIG. 3 is a side view illustrating a retard-separation operation in the printer according to the embodiment of the invention.

FIG. 3 is a side view illustrating a retard-separation operation in the printer according to the embodiment of the invention.

As shown in FIG. 3, the paper sheet P separated by the bank separation member 31 is further fed the downstream side in the feed direction by the pickup roller 21. Further, the paper sheet P is fed to the nip point N where the retard roller 41 of the main separation section 40 is in contact with the intermediate driving roller 50.

Meanwhile, since the preliminary separation section 30 is merely a preliminary separator in this embodiment, there is a concern that overlapping several paper sheets P are fed to the main separation section 40. Hereinafter, description will be made on the assumption that overlapping several paper sheets P are fed.

When the doubly-fed paper sheets P are fed to the nip point N, only the uppermost paper sheet P1 is in direct contact with the intermediate driving roller 50. Further, the front end of the following paper sheet P2 is in contact with the retard roller 41 that requires a predetermined load when being rotated.

Assuming that a friction coefficient between the intermediate driving roller 50 and the uppermost paper sheet P1 is denoted by $\mu 4$, a friction coefficient between the paper sheets P is denoted by $\mu 2$, and a friction coefficient between the retard roller 41 and the paper sheet P is denoted by $\mu 5$, relationships of "friction coefficient $\mu 4$>friction coefficient $\mu 2$" and "friction coefficient $\mu 5$>friction coefficient $\mu 2$" are satisfied.

Accordingly, it may be possible to make the feed force applied to the uppermost paper sheet P1 be larger than the feed force applied to the following paper sheet P2.

In this case, the load of the retard roller 41 is larger than the feed force applied to the following paper sheet P2.

Accordingly, the intermediate driving roller 50 is rotated clockwise in FIG. 3, so that only the uppermost paper sheet P1 may be fed toward the downstream side in the feed direction.

More specifically, the front end of the following paper sheet P2 is held at the nip point N by the load of the retard roller 41, so that slip may occur between the uppermost paper sheet P1 and the succeeding paper sheet P2. Accordingly, the uppermost paper sheet P1 may be separated from the following paper sheet P2, and be fed toward the downstream side in the feed direction. Further, the front end of the uppermost paper sheet P1 passes the second assist roller 51, and reaches the third assist roller 52 while being guided by the U-shaped outer sheet guide portion 11 and the inner sheet guide portion 12.

Figure 4:
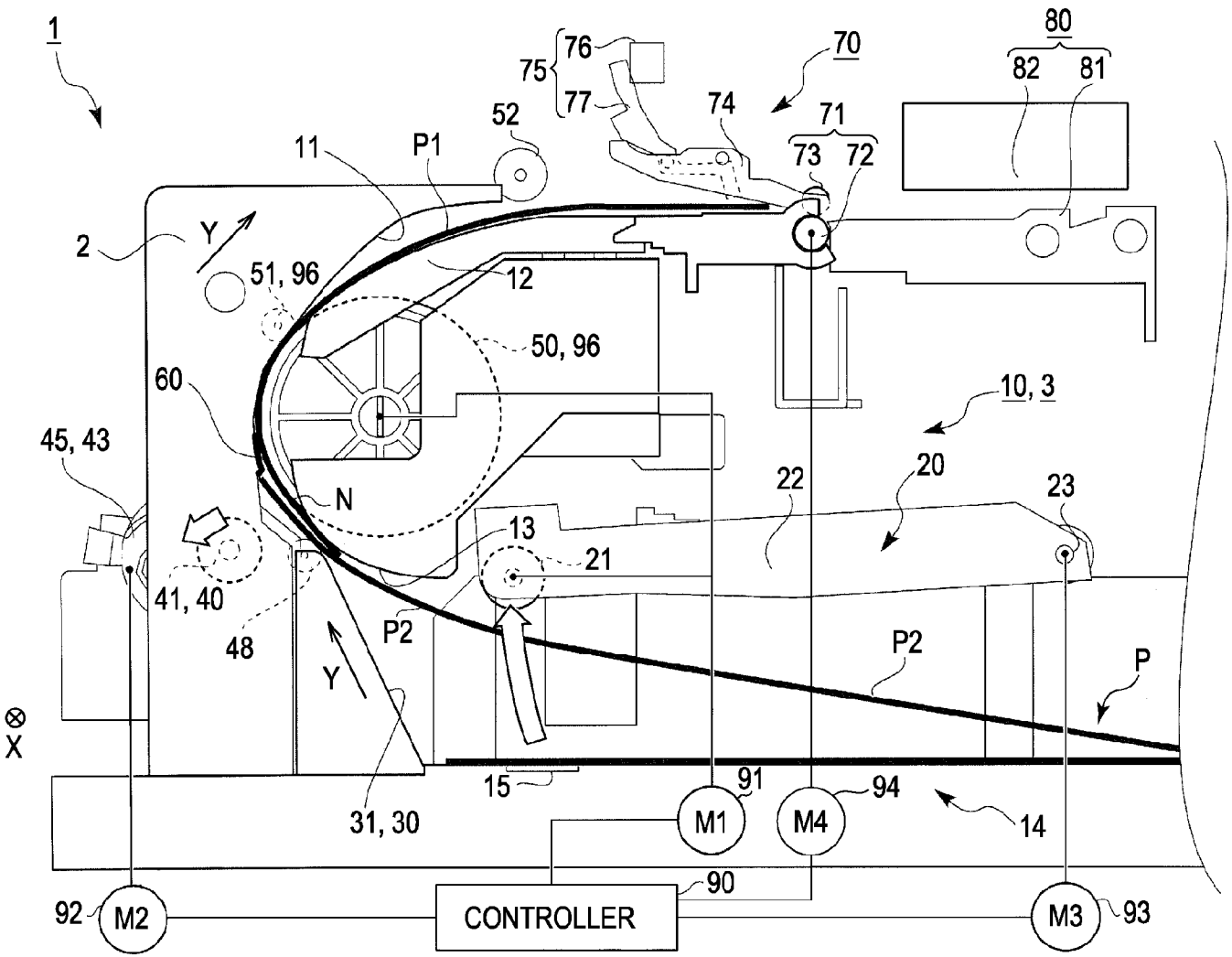
FIG. 4 is a side view illustrating a retard-separation operation in the printer according to the embodiment of the invention.
Figure 5:
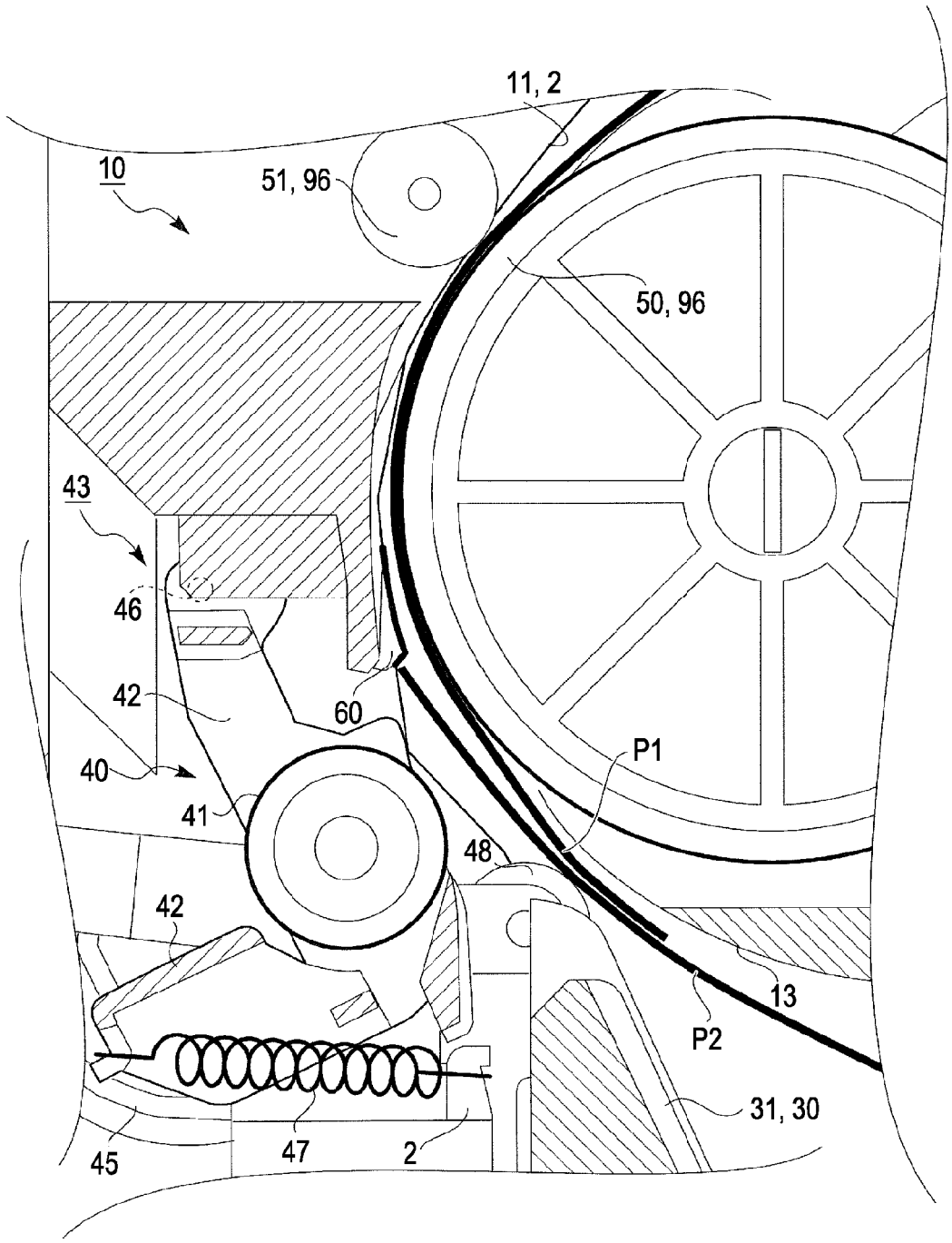
FIG. 5 is an enlarged side cross-sectional view showing the enlarged appearance of the printer in the state of FIG. 4.

FIG. 4 is a side view illustrating a retard-separation operation in the printer according to the embodiment of the invention. FIG. 5 is an enlarged side cross-sectional view showing the enlarged appearance of the printer in the state of FIG. 4.

If the uppermost paper sheet P1 is further fed toward the downstream side of the intermediate driving roller 50 in the feed direction as shown in FIGS. 4 and 5, the front end of the uppermost paper sheet P1 is detected by the paper sheet detector 75. Specifically, the front end of the uppermost paper sheet P1 is bumped against one end of the paper sheet detecting lever 77, and makes the paper sheet detecting lever 77 swing. In this case, since the other end of the paper sheet detecting lever 77 is deviated from a gap between the light-emitting part and the light-receiving part of the sensor 76, the paper sheet detector 75 is turned on.

The controller 90 recognizes this as a trigger, and separates the retard roller 41 from the intermediate driving roller 50. Specifically, the controller makes the cam 45 be rotated by the separation motor 92, and makes the retard holder 42 swing so that the retard holder is retreated from the intermediate driving roller 50 against the pushing force of the push spring 47.

Further, the controller 90 drives the arm motor 93 and makes the arm 22 swing about the arm shaft 23 so that the pickup roller 21 is retreated from the paper sheets P placed in the cassette 14.

Meanwhile, a timing to begin to separate the retard roller 41 from the intermediate driving roller may be a timing to rotate the intermediate driving roller 50 and the pickup roller 21 by a predetermined angle.

If the retard roller 41 is separated from the intermediate driving roller, the uppermost paper sheet P1 is fed by the intermediate driving roller 50 and the second assist roller 51.

Further, if the pickup roller 21 is separated from the following paper sheet, a feed force is not directly applied to the following paper sheet P2 from the intermediate driving roller 50 and the pickup roller 21. Accordingly, the following paper sheet P2 of which the front end is held by the retard roller 41 returns to the cassette 14 due to its own weight.

Meanwhile, the rear end of the preceding paper sheet P1 that is the uppermost paper sheet fed by the intermediate driving roller 50 is in contact with the front end of the succeeding paper sheet P2 that is the following paper sheet of which the front end is held by the retard roller 41. Accordingly, a feed force is indirectly applied to the succeeding paper sheet P2.

Convex sheet front end regulating ribs 60 and 60 are provided on the U-shaped outer sheet guide portion 11 on the downstream side of the nip point N, which is formed between the retard roller 41 and the intermediate driving roller 50, in the feed direction. Further, the sheet front end regulating ribs 60 and 60 are provided near both ends of the retard roller 41 in the width direction X of the paper sheet P.

The feed path is bent in a U shape. Accordingly, when the retard roller 41 is separated from the intermediate driving roller, the front end of the succeeding paper sheet P2 that is the following paper sheet is displaced toward the U-shaped outer sheet guide portion.

Therefore, after the retard roller 41 is separated from the intermediate driving roller, the sheet front end regulating ribs 60 and 60 may be bumped against the front end of the succeeding paper sheet P2 that is the following paper sheet and regulate the displacement of the succeeding paper sheet toward the downstream side in the feed direction.

That is, it may be possible to reliably prevent the succeeding paper sheet P2 from being fed toward the downstream side in the feed direction. As a result, it may be possible to prevent the succeeding paper sheet P2 from being successively fed together with the preceding paper sheet P1, that is, it may be possible to prevent successive sheet feeding. The successive sheet feeding is apt to occur when the contact area between the succeeding paper sheet P2 and the preceding paper sheet P1 is large, particularly, when the paper sheet P having a large area is fed. Specifically, the successive sheet feeding is apt to occur in the case of a paper sheet of which the size is A3 or more. In other words, if the size of a paper sheet is A4 or less, the contact area is small, so that the successive sheet feeding is not apt to occur.

In this case, if the pickup roller 21 is separated from the succeeding paper sheet, it may be possible to reduce the deflection of the succeeding paper sheet P2. That is, it may be possible to make the attitude of the succeeding paper sheet P2 as straight as possible. Accordingly, it may be possible to actively make the front end of the succeeding paper sheet P2 be bumped against the sheet front end regulating ribs 60 and 60.

Further, the rear end of the preceding paper sheet P1 pushes the front end of the succeeding paper sheet P2 toward the U-shaped outer sheet guide portion that is provided on the outside of the U-shaped path. Accordingly, it may be possible to actively make the front end of the succeeding paper sheet P2 be bumped against the sheet front end regulating ribs 60 and 60.

As a result, it may be possible to reliably prevent the successive sheet feeding. That is, it may be possible to prevent the successive sheet feeding without a so-called return lever that has been provided in the related art.

Further, it may be possible to separate the retard roller 41 at an earlier timing than the related art. As a result, it may be possible to reduce so-called backlash, which is caused by the load of the retard roller 41, at an early timing. For example, when the front end of the uppermost paper sheet P1 reaches the second assist roller 51, the retard roller 41 may begin to be separated.

Figure 6:
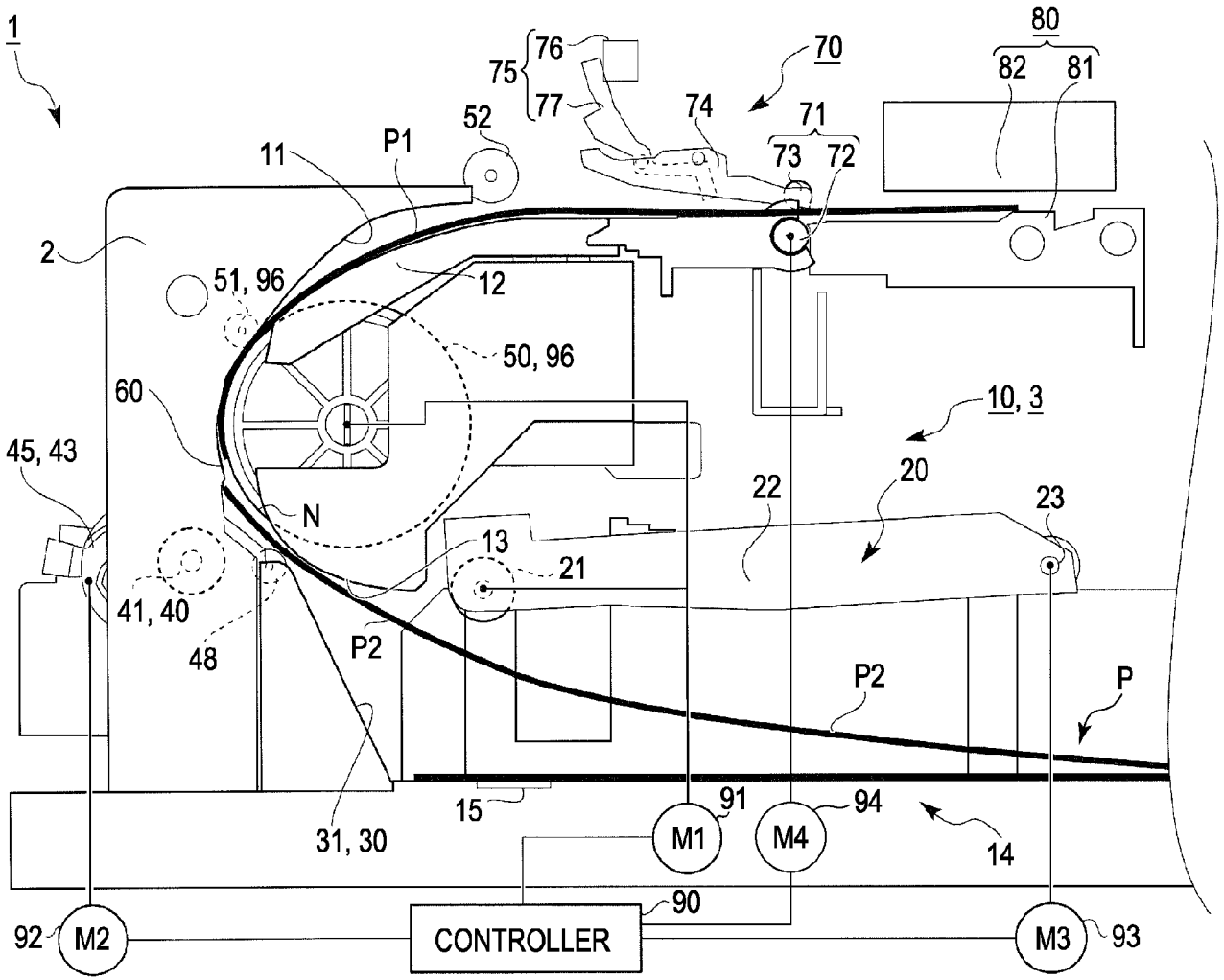
FIG. 6 is a side view illustrating a retard-separation operation in the printer according to the embodiment of the invention.

FIG. 6 is a side view illustrating a retard-separation operation in the printer according to the embodiment of the invention.

If the preceding paper sheet P1, which is the uppermost paper sheet, is further fed toward the downstream side of the intermediate driving roller 50 in the feed direction from the state of FIG. 5 as shown in FIG. 6, the rear end of the preceding paper sheet P1 passes through a gap between the intermediate driving roller 50 and the retard roller 41.

Herein, a winding prevention portion 13 is provided on the inside of the U-shaped path. Specifically, the winding prevention portion is provided on the upstream side of the nip point N, which is formed between the retard roller 41 and the intermediate driving roller 50 in the feed direction Y, in the feed direction, so as to cover the intermediate driving roller 50. Accordingly, the winding prevention portion 13 may prevent the succeeding paper sheet P2 from being in contact with the intermediate driving roller 50. As a result, there is no concern that the intermediate driving roller 50 directly applies a feed force to the succeeding paper sheet P2.

Further, the front end of the preceding paper sheet P1 is nipped by the transport roller pair 71. After that, skew correction is performed, and recording is performed by the recording device 80 while the preceding paper sheet P1 is transported toward the downstream side in the feed direction by the transport roller pair 71. Then, the paper sheet is discharged to a discharge tray (not shown), which is provided at the front portion of the printer 1, by a discharge device (not shown).

Subsequently, a skew-correction operation will be described.

Figure 7:
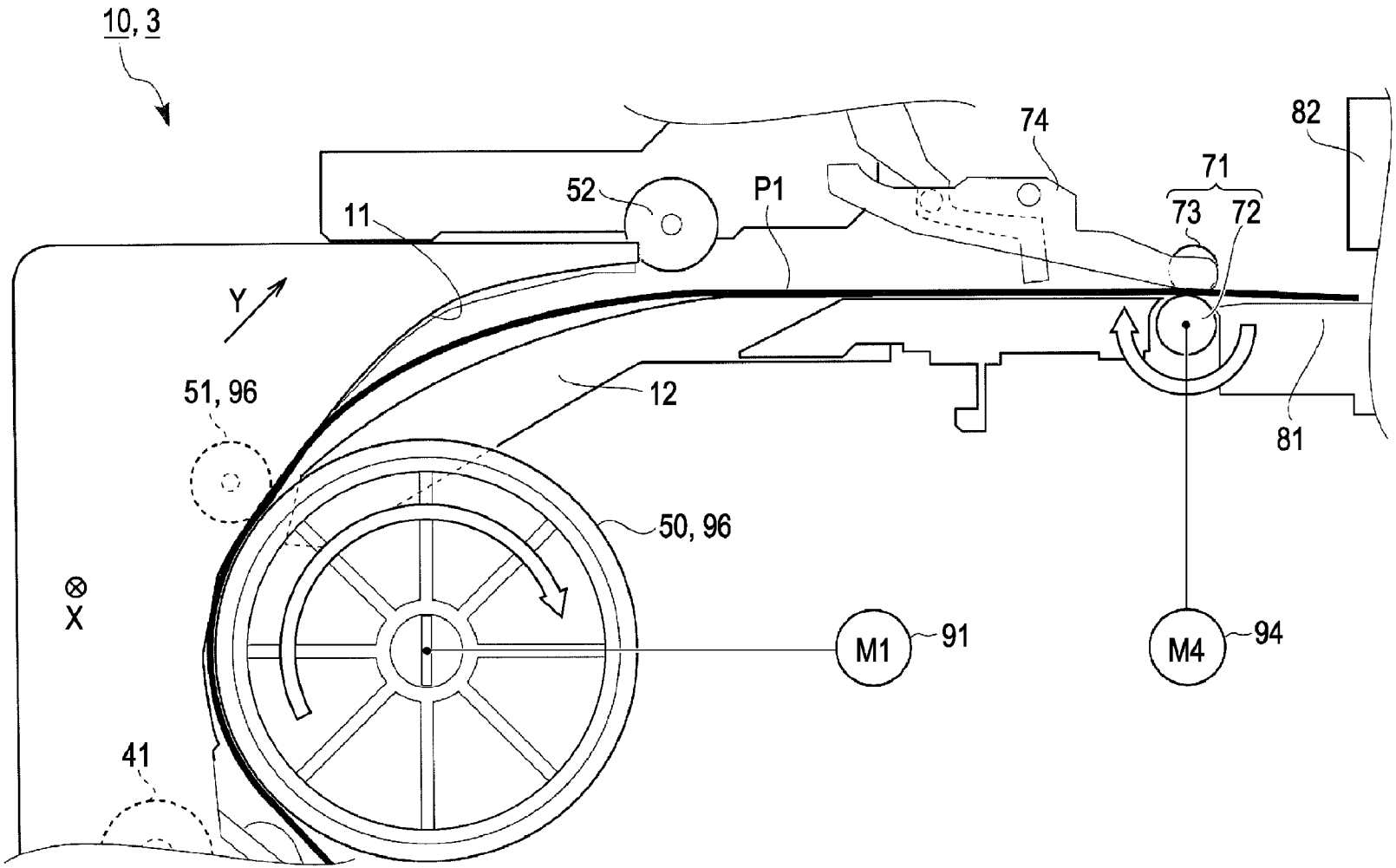
FIG. 7 is a side view illustrating an initial biting state at the time of skew correction in the embodiment of the invention.

FIG. 7 is a side view illustrating an initial biting state at the time of skew correction in the embodiment of the invention.

As shown in FIG. 7, the controller 90 rotates the intermediate driving roller 50 clockwise by driving the feeding motor 91 in a normal direction. Further, the controller rotates the transport driving roller 72 clockwise in FIG. 7 by driving the transport motor 94 in the normal direction.

Accordingly, the front end of the preceding paper sheet P1 is nipped by the transport roller pair 71 as described above. Further, the preceding paper sheet P1 is fed until the front end of the paper sheet P1 is positioned at a position, which is positioned on the downstream side of the transport roller pair 71 and distant from the transport roller pair by a predetermined distance.

In this case, there is a concern that the attitude of the front end of the paper sheet P1 is inclined with respect to a nip line of the transport roller pair 71. This is so-called skew. Meanwhile, the nip line is parallel to the X-axis direction.

The following operations are performed for so-called skew correction that removes the inclination with respect to the nip line of the paper sheet P1.

Figure 8:
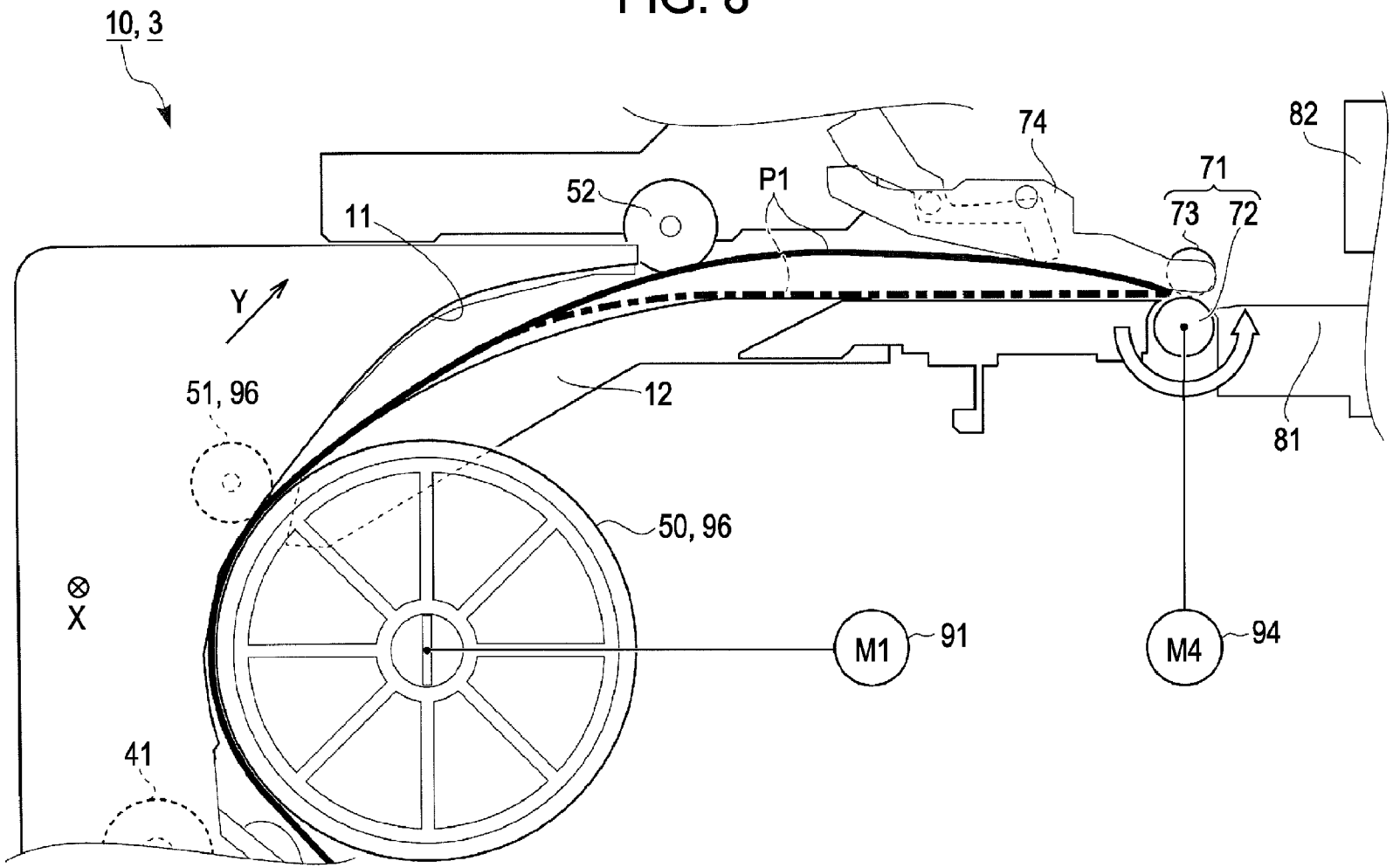
FIG. 8 is a side view illustrating a discharge state at the time of the skew correction in the embodiment of the invention.

FIG. 8 is a side view illustrating a discharge state at the time of the skew correction in the embodiment of the invention.

As shown in FIG. 8, the controller 90 stops the intermediate driving roller 50 by stopping the feeding motor 91 from the state of FIG. 7. Further, the controller rotates the transport driving roller 72 counterclockwise in FIG. 8 by changing the driving direction of the transport motor 94 into reverse direction. Accordingly, the front end of the preceding paper sheet P1 is fed toward the upstream side of the transport roller pair 71 in a reverse direction by the transport roller pair 71. This is a so-called discharge operation.

In this case, the intermediate driving roller 50 is at a stop. Accordingly, the preceding paper sheet P1 may be deflected between the transport roller pair 71 and the feed roller pair 96, which includes the intermediate driving roller 50 and the second assist roller 51, in the feed direction Y. Further, the front end of the preceding paper sheet P1 may follow the nip line of the transport roller pair 71.

If the paper sheet P1 is inclined with respect to the nip line in the state shown in FIG. 7, one end of the paper sheet P1 in the width direction X is significantly deflected as shown by a solid line in FIG. 8 and the other end of the paper sheet P1 in the width direction X is slightly deflected as shown by a chain line. Further, the difference between one and the other ends of the paper sheet P1 in the width direction X is proportional to the inclination of the front end of the paper sheet in the state shown in FIG. 7.

Meanwhile, if the paper sheet P1 is not inclined with respect to the nip line in the state shown in FIG. 7, one and the other ends of the paper sheet in the width direction X correspond to the attitude shown by a solid line in FIG. 8.

Figure 9:
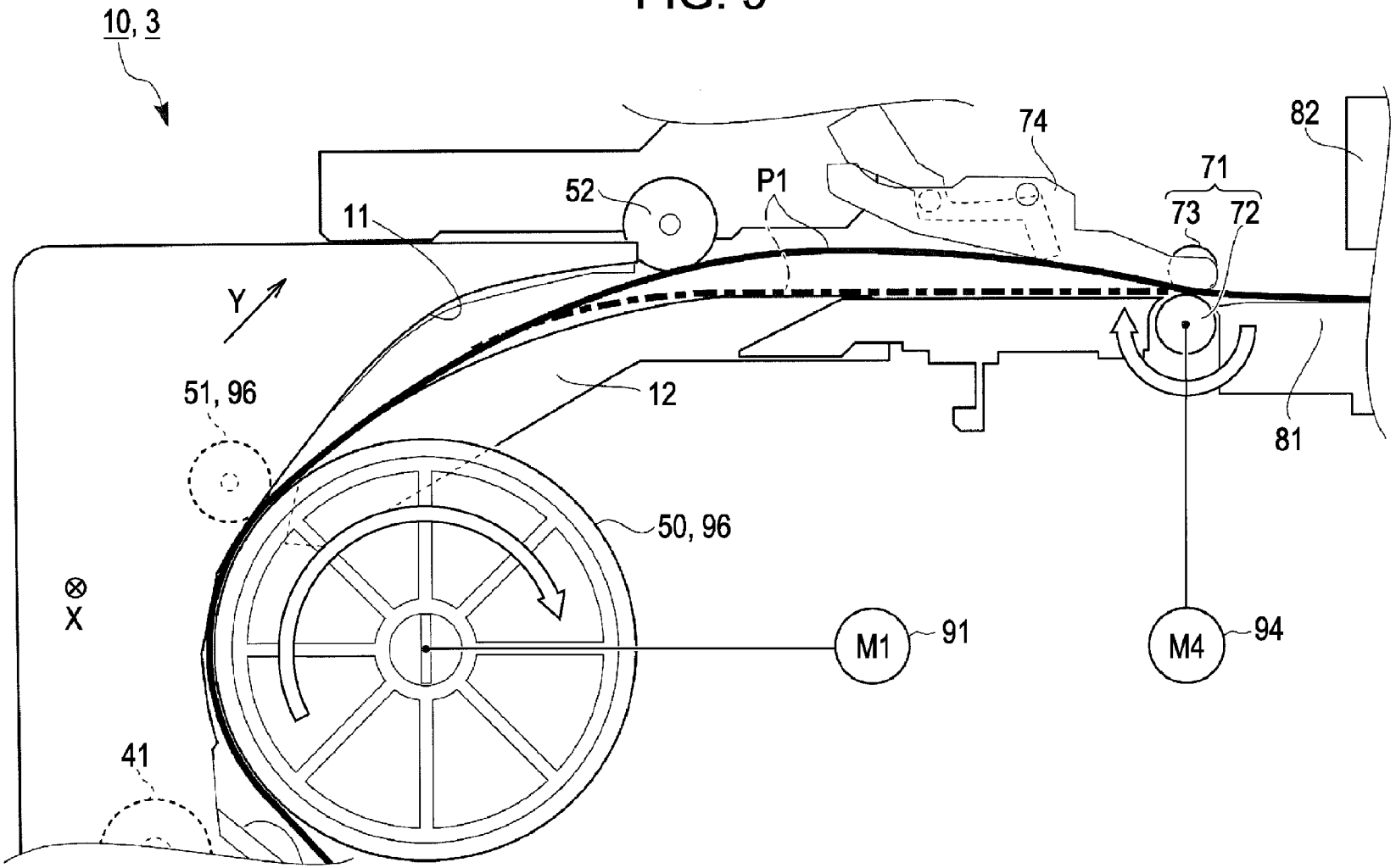
FIG. 9 is a side view illustrating a heading state at the time of the skew correction in the embodiment of the invention.

FIG. 9 is a side view illustrating a heading state at the time of the skew correction in the embodiment of the invention.

As shown in FIG. 9, the controller 90 rotates the intermediate driving roller 50 clockwise by driving the feeding motor 91 in a normal direction from the state of FIG. 8. Further, the controller rotates the transport driving roller 72 clockwise in FIG. 9 by driving the transport motor 94 in a normal direction. Accordingly, it may be possible to make the front end of the paper sheet P1, which is not inclined with respect to the nip line, be nipped by the transport roller pair 71. Then, the front end of the preceding paper sheet P1 is fed to a recording starting position, and the feeding motor 91 and the transport motor 94 are stopped. This is a so-called heading operation.

Herein, the recording starting position is a position that faces a nozzle array (not shown) of the recording head 82.

In this case, the difference between one and the other ends of the paper sheet P in the width direction X is not removed yet between the feed roller pair 96 and the transport roller pair 71 in the feed direction Y.

As described in the related art, there is a concern that difference is generated between the transport distance of the other end of the paper sheet and the transport distance of one end of the paper sheet at the transport roller pair 71 due to the difference between the deflection of one end of the paper sheet and the deflection of the other end of the paper sheet.

Accordingly, the following operations are performed to remove the difference between the deflection of one end of the paper sheet and the deflection of the other end of the paper sheet.

Figure 10:
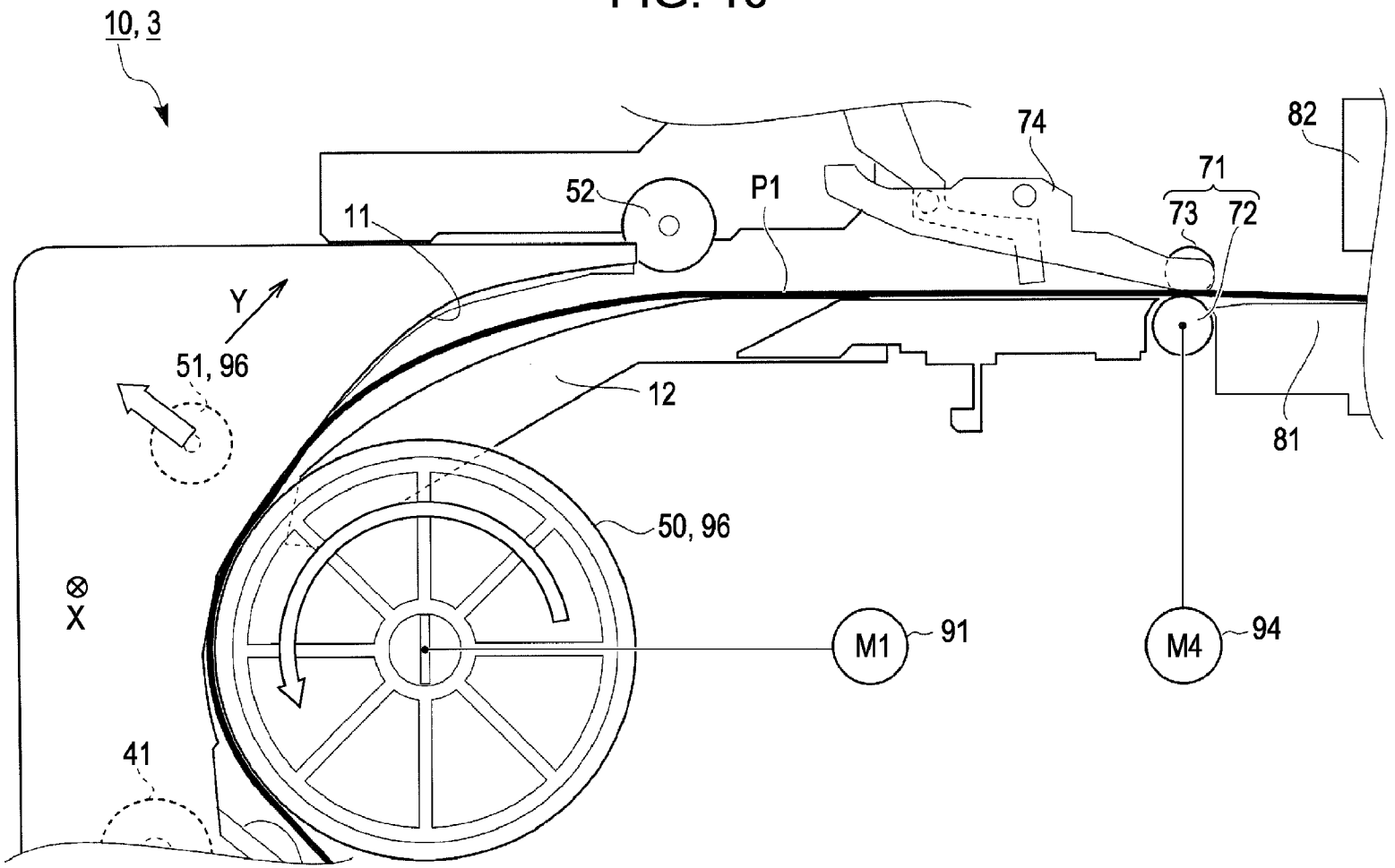
FIG. 10 is a side view illustrating a reverse-rotation operation after the skew correction in the embodiment of the invention.
Figure 11A:
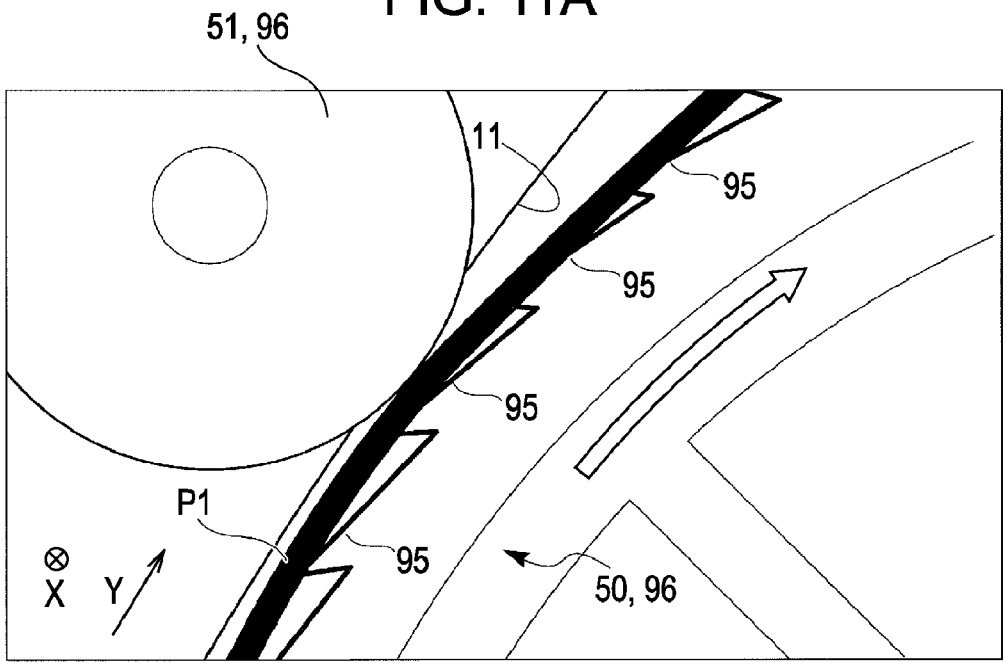
FIGS. 11A and 11B are side views showing the surface state of an intermediate driving roller of the embodiment of the invention.
Figure 11B:
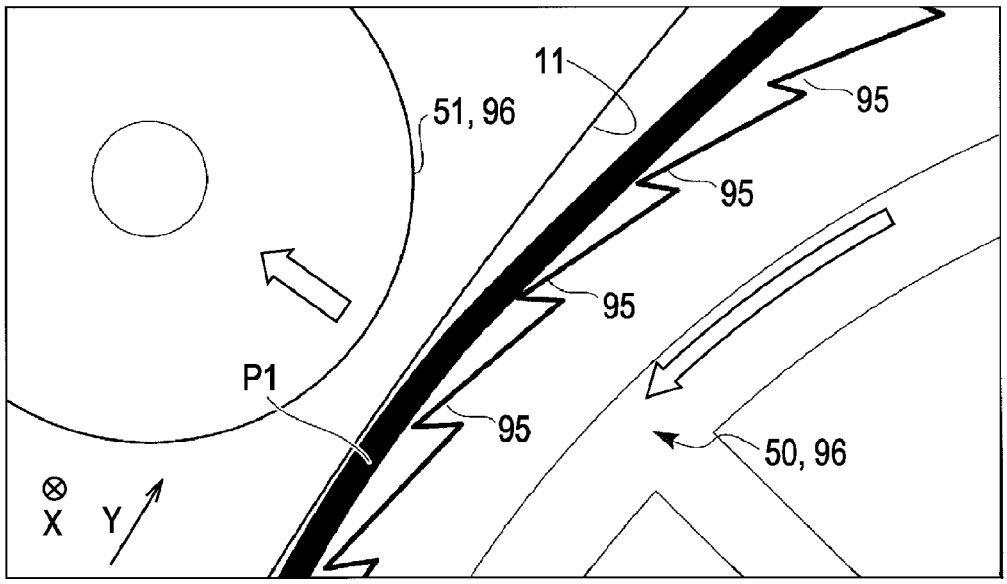

FIG. 10 is a side view illustrating a reverse-rotation operation after the skew correction in the embodiment of the invention. FIGS. 11A and 11B are side views showing the surface state of the intermediate driving roller of the embodiment of the invention. FIG. 11A shows that the intermediate driving roller is driven in a normal direction. Meanwhile, FIG. 11B shows that the intermediate driving roller is driven in a reverse direction.

As shown in FIG. 10, first, the controller 90 moves the second assist roller 51 by a separation mechanism (not shown) from the state of FIG. 9 so that the second assist roller is separated from the intermediate driving roller 50.

After that, the controller rotates the intermediate driving roller 50 counterclockwise in FIG. 10 by driving the feeding motor 91 in a reverse direction. Meanwhile, the transport motor 94 is at a stop.

In this case, the second assist roller 51 is separated from the intermediate driving roller 50. Accordingly, while sliding between the paper sheet P1 and the periphery of the intermediate driving roller 50, the intermediate driving roller 50 may slightly apply a reverse feed force to the paper sheet P1 toward the upstream side in the feed direction. As a result, it may be possible to reduce the deflection of the paper sheet P1 that is generated between the feed roller pair 96 and the transport roller pair 71 in the feed direction Y.

In addition, it may be possible to remove the difference between the deflection of one end of the paper sheet P1 and the deflection of the other end of the paper sheet. As a result, there is no concern that difference is generated between the transport distance of the other end of the paper sheet and the transport distance of one end of the paper sheet at the transport roller pair 71 while recording is performed thereafter.

Further, when the intermediate driving roller 50 is rotationally driven in a reverse direction, the pickup roller 21 is separated from the paper sheet P as described above (see FIG. 6). Accordingly, there is no concern that the removal of the difference between the deflection of one end of the paper sheet P1 and the deflection of the other end of the paper sheet is obstructed.

As shown in FIG. 11A and 11B, the periphery of the intermediate driving roller 50 is formed of a polished rubber roller. Further, rubber scales 95, 95 . . . are formed on the peripheral surface by polishing so as to correspond to normal scales when the intermediate driving roller 50 is rotationally driven clockwise in FIG. 11A (in a normal direction) and inverse scales when the intermediate driving roller is rotationally driven counterclockwise in FIG. 11B (in a reverse direction). Accordingly, when the intermediate driving roller 50 is rotationally driven in a normal direction and feeds the paper sheet P1 toward the downstream side in the feed direction as shown in FIG. 11A, it may be possible to increase the contact area between the surface of the rubber roller and the surface of the paper sheet P1. As a result, friction is increased, so that a large feed force may be applied to the paper sheet P1 and the paper sheet P1 may be fed with high accuracy.

Meanwhile, when the intermediate driving roller 50 is rotationally driven in a reverse direction and feeds the paper sheet P1 toward the upstream side in the feed direction as shown in FIG. 11B, the second assist roller 51 is separated from the intermediate driving roller 50 and the rubber scales 95, 95 . . . correspond to inverse scales. Accordingly, when the paper sheet P1 is fed toward the upstream side in the feed direction, it may be possible to decrease the contact area between the surface of the rubber roller and the surface of the paper sheet P1. As a result, friction is decreased, so that a feed force to be applied to the paper sheet P1 may be actively decreased. For this reason, even though the intermediate driving roller 50 is rotationally driven in a reverse direction while the transport driving roller 72 is stopped, there is little concern that a portion of the paper sheet P1 nipped by the transport roller pair 71 is damaged. That is, there is no concern that the surface of the paper sheet P1 is damaged.

After that, the controller stops the reverse rotation driving of the intermediate driving roller 50. Then, the controller rotates the intermediate driving roller 50 clockwise in the drawing by driving the feeding motor 91 in a normal direction. Further, the controller rotates the transport driving roller 72 clockwise in the drawing by driving the transport motor 94 in a normal direction. Subsequently, as described above, recording is performed by the recording device 80 while the preceding paper sheet P1 is transported toward the downstream side in the feed direction by the transport roller pair 71. Then, the paper sheet is discharged to a discharge tray (not shown), which is provided at the front portion of the printer 1, by a discharge device (not shown).

Meanwhile, a timing to rotate the intermediate driving roller clockwise may be a timing to begin to pick up the succeeding paper sheet to be described below. That is, during the transportation, a feed force is generated by the transport roller pair 71 and the feed roller pair 96, and a feed force is generated by only the transport roller pair 71.

Figure 12:
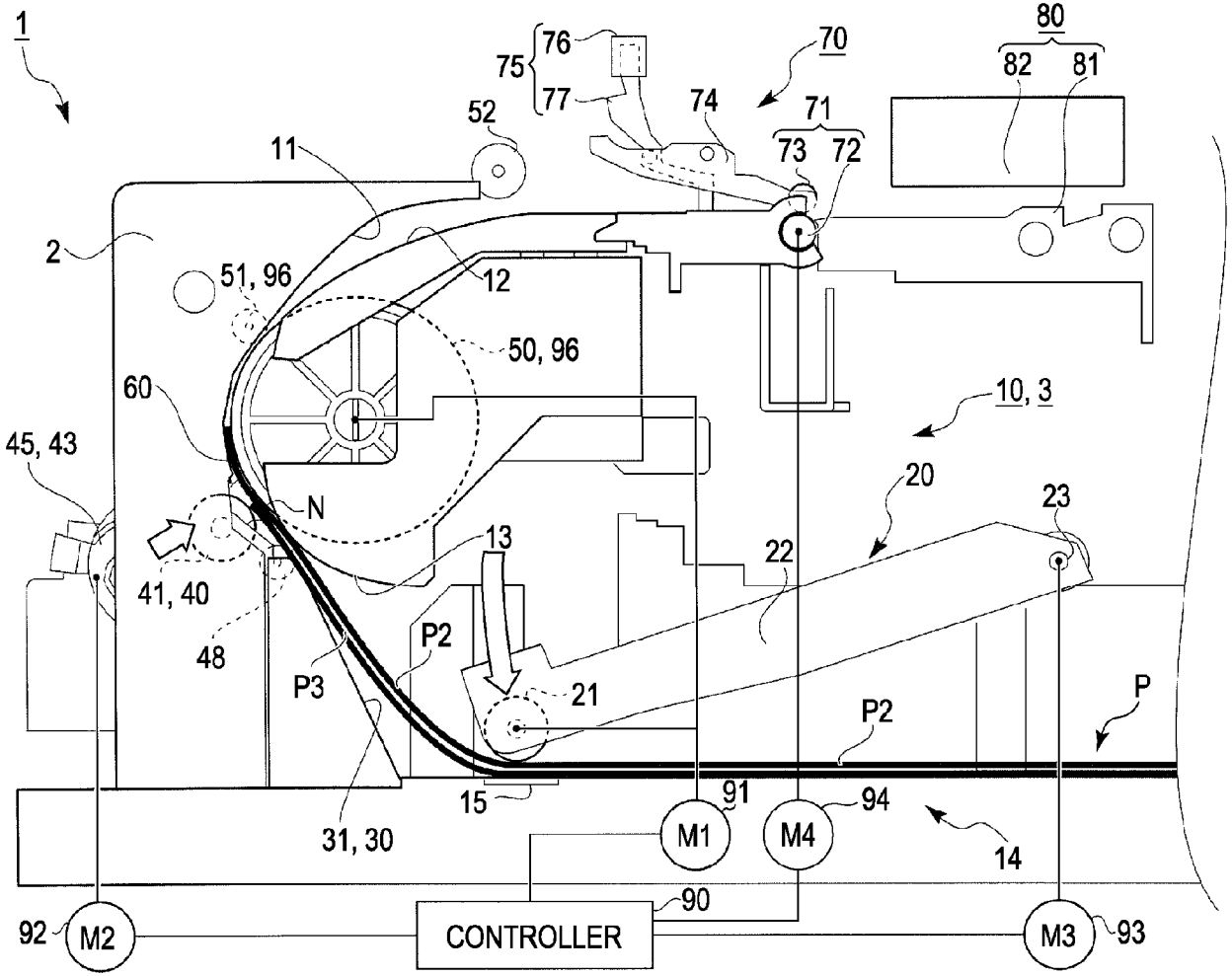
FIG. 12 is a side view showing the appearance of the printer when the succeeding paper sheet is picked up in the embodiment of the invention.
Figure 13:
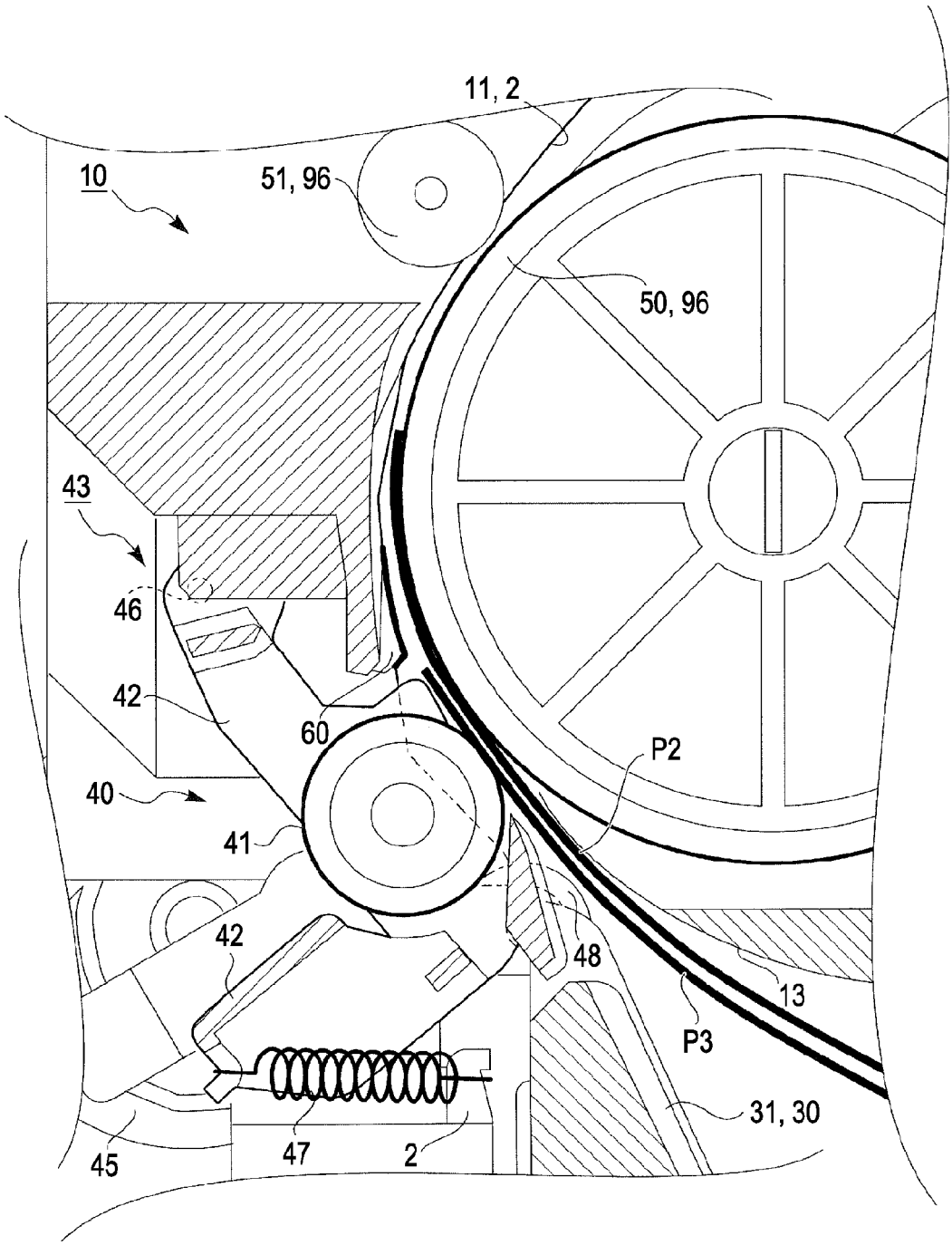
FIG. 13 is an enlarged side cross-sectional view showing the enlarged appearance of the printer in the state of FIG. 12.

FIG. 12 is a side view showing the appearance of the printer when the succeeding paper sheet is picked up in the embodiment of the invention. FIG. 13 is an enlarged side cross-sectional view showing the enlarged appearance of the printer in the state of FIG. 12.

After the preceding paper sheet P1 is transported to the recording device 80, paper sheets P may be continuously fed as shown in FIGS. 12 and 13. Specifically, the controller 90 moves the retard roller 41 and the second assist roller 51 so that the retard roller and the second assist roller approach the intermediate driving roller 50. More specifically, the controller rotates the cam 45 by the separation motor 92, and thus makes the retard holder 42 swing so that the retard holder approaches the intermediate driving roller 50 by the pushing force of the push spring 47. Likewise, the controller operates a separation mechanism (not shown), and thus moves the second assist roller 51 so that the second assist roller approaches the intermediate driving roller 50.

Further, the controller 90 drives the arm motor 93, and thus makes the arm 22 swing about the arm shaft 23 so that the pickup roller 21 approaches the paper sheets P placed in the cassette 14.

In this case, the succeeding paper sheet P2, which is held by the sheet front end regulating ribs 60 and 60, approaches the retard roller 41 and is thus displaced toward the intermediate driving roller. Then, the succeeding paper sheet is nipped by the intermediate driving roller 50 and the retard roller 41. Accordingly, the state of the front end of the succeeding paper sheet P2 is changed from the state where the front end of the succeeding paper sheet is regulated by the sheet front end regulating ribs 60 and 60 into the state where the front end of the succeeding paper sheet is released. In this state, the intermediate driving roller 50 and the pickup roller 21 are rotated clockwise in the drawing as described above.

In this case, if one succeeding paper sheet P2 is held by the sheet front end regulating ribs 60 and 60, the one paper sheet P2 is fed toward the downstream side in the feed direction.

Further, if a plurality of succeeding paper sheets P2, P3 . . . is held by the sheet front end regulating ribs 60 and 60, relationships of "friction coefficient $\mu 4$>friction coefficient $\mu 2$" and "friction coefficient $\mu 5$>friction coefficient $\mu 2$" are satisfied as described above.

Accordingly, it may be possible to make the feed force, which is applied to the uppermost paper sheet P2 by the intermediate driving roller 50, be larger than the feed force that is applied to the following paper sheet P3 by the intermediate driving roller. That is, it may be possible to separate the following paper sheet P3 by the retard roller 41, and to feed only the uppermost paper sheet P2 toward the downstream side in the feed direction. In this case, since the front end of the uppermost paper sheet P2 approaches the retard roller 41 and is thus displaced toward the intermediate driving roller as described above, there is no concern that the front end of the uppermost paper sheet is regulated by the sheet front end regulating ribs 60 and 60.

The feed device 3 according to this embodiment, which serves as a medium feeding device, includes the feed roller pair 96, the transport roller pair 71, a medium guiding path section, and the controller 90. The feed roller pair includes the intermediate driving roller 50 that serves as a feed driving roller driven by power, and the second assist roller 51 that serves as a feed driven roller to be rotationally driven. The intermediate driving roller 50 and the second assist roller 51 may be separated from each other, and the feed roller pair feeds the paper sheet P, which is an example of a medium to be fed, toward the downstream side in the feed direction. The transport roller pair includes the transport driving roller 72 that is disposed on the downstream side of the feed roller pair 96 in the feed direction and is driven by power, and the transport driven roller 73 that is rotationally driven. The transport roller pair transports the paper sheet P, which is fed by the feed roller pair 96, toward the downstream side in the feed direction. The medium guiding path section guides the paper sheet P, which is to be fed, up to the transport roller pair 71. The medium guiding path section includes the U-shaped outer sheet guide portion 11, the inner sheet guide portion 12, the winding prevention portion 13, and the bank separation member 31. The controller makes the front end of the paper sheet P, which is a downstream end in the feed direction, be nipped by the transport roller pair 71 by rotationally driving the transport driving roller 72 in a normal direction at the time of skew correction; makes the front end of the paper sheet P follow the nip line of the transport roller pair 71 by rotationally driving the transport driving roller 72 in a reverse direction; makes the front end of the paper sheet P be nipped by the transport roller pair 71 by rotationally driving the transport driving roller 72 and the intermediate driving roller 50 in the normal direction; and makes the second assist roller 51 and the intermediate driving roller 50 be separated from each other while the transport driving roller 72 is stopped, and rotationally drives the intermediate driving roller 50 in the reverse direction.

Further, in this embodiment, the intermediate driving roller 50 is a polished rubber roller. When the intermediate driving roller is rotationally driven in the reverse direction, rubber scales 95, 95 . . . correspond to inverse scales.

Furthermore, in this embodiment, the U-shaped outer sheet guide portion 11, the inner sheet guide portion 12, the winding prevention portion 13, and the bank separation member 31 forms a U-shaped path from the pickup roller 21 up to the transport roller pair 71 in side view.

In addition, in this embodiment, the feed device further includes the pickup roller 21 that picks up a placed paper sheet P and feeds the paper sheet toward the downstream side in the feed direction. When the second assist roller 51 and the intermediate driving roller 50 are separated from each other, the pickup roller 21 is separated from the placed paper sheet P.

The printer 1 according to this embodiment, which serves as a recording apparatus, includes the feed device 3 that serves as a feed device and a recording device 80. The feed device picks up a placed paper sheet P, which is an example of a recording medium, and feeds the paper sheet toward the downstream side in the feed direction. The recording device performs recording on the fed paper sheet P by the recording head 82.

Another Embodiment 1

Figure 14:
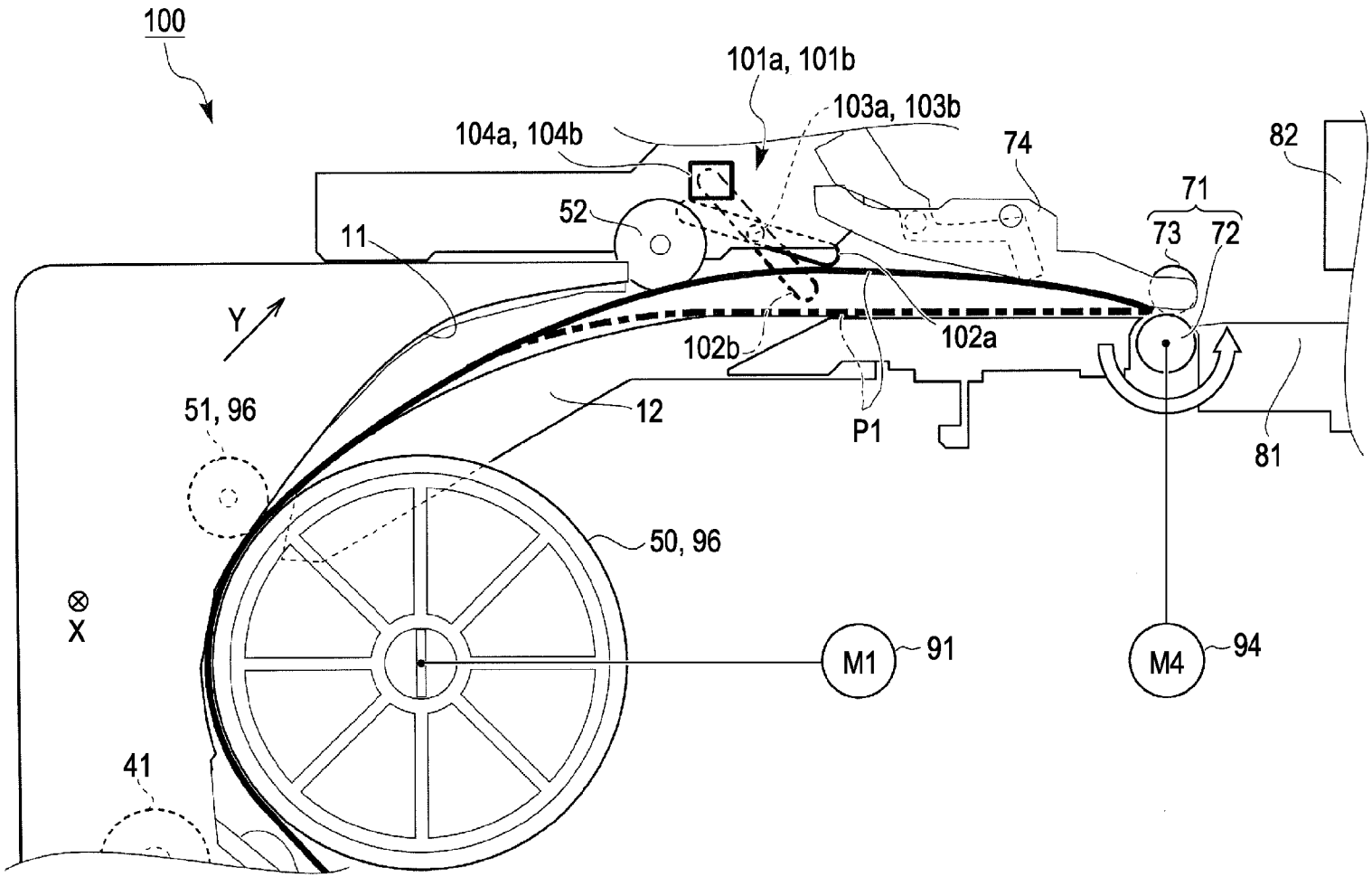
FIG. 14 is a side view illustrating a discharge state at the time of skew correction in another embodiment 1.

FIG. 14 is a side view illustrating a discharge state at the time of skew correction in another embodiment 1.

As shown in FIG. 14, in a printer 100 according to another embodiment 1, attitude detectors 101*a* and 101*b* that detect the attitude of a deflected paper sheet P1 are provided between a feed roller pair 96 and a transport roller pair 71 in a feed direction Y. Specifically, the attitude detectors are provided to detect whether the deflection of the paper sheet exceeds predetermined deflection. Further, a pair of attitude detectors 101*a* and 101*b* is provided in a width direction X. Specifically, the pair of attitude detectors is provided at positions that face one and the other ends of the paper sheet P1 in the width direction X.

The attitude detectors 101*a* and 101*b* include levers 102*a* and 102*b* and detection sensors 104*a* and 104*b*, respectively. The levers 102*a* and 102*b* are provided to swing about lever shafts 103*a* and 103*b*, respectively. Further, forces are applied to the levers due to the weight of the levers so that the levers are rotated clockwise in FIG. 14.

Meanwhile, the lever may be pushed clockwise by a pushing member such as a spring.

Further, since being the same as those of the above-mentioned embodiment, the other members are denoted by the same reference numerals and the description thereof will be omitted.

Furthermore, one ends of the levers 102*a* and 102*b* protrude into a guiding path and may be in contact with the paper sheet P1. Meanwhile, the other ends of the levers 102*a* and 102*b* are positioned between light-emitting parts and light-receiving parts (not shown) of the detection sensors 104*a* and 104*b*, respectively, thereby blocking light. If the other ends of the levers 102*a* and 102*b* are deviated from gaps between the light-emitting parts and the light-receiving parts, respectively, light passes through the gaps. When the other ends of the levers 102*a* and 102*b* are deviated from the gaps between the light-emitting parts and the light-receiving parts, respectively, the attitude detectors 101*a* and 101*b* are turned on. When the other ends of the levers 102*a* and 102*b* are positioned between the light-emitting parts and the light-receiving parts, respectively, the attitude detectors are turned off.

Meanwhile, turning-on and turning-off may be vice versa.

Like in the above-mentioned embodiment, one end (P1 shown by a solid line in FIG. 14) of the paper sheet P1 in the width direction X is significantly deflected in a discharge operation (see FIG. 8) at the time of the skew correction in the embodiment of the invention. Accordingly, the paper sheet is in contact with the lever 102*a* corresponding to the one end, and rotates the lever 102*a* counterclockwise. As a result, the attitude detector 101*a*, which corresponds to the one end of the paper sheet, is turned on.

Meanwhile, since the other end (P1 shown by a chain line in FIG. 14) of the paper sheet P1 in the width direction X is merely slightly deflected, the paper sheet is not in contact with the lever 102*b* corresponding to the other end. Accordingly, the attitude detector 101*b*, which corresponds to the other end of the paper sheet, is turned off.

In this case, heading (see FIG. 9) is performed like in the above-mentioned embodiment. After that, a reverse-rotation operation (see FIG. 10) is performed. Further, when the attitude detector 101*a*, which corresponds to the one end of the paper sheet, is switched to be turned off, the reverse rotation driving of the intermediate driving roller 50 is stopped.

After that, as described above, recording is performed by the recording device 80 while the preceding paper sheet P1 is transported by the transport roller pair 71.

Further, in the discharge operation at the time of the skew correction, there is considered a case where the deflection of one end of the paper sheet P1 in the width direction X is not different from the deflection of the other end of the paper sheet P1 in the width direction X. That is, there is considered a case where the front end of the paper sheet P1 is not inclined with respect to the nip line and the deflection of the one end of the paper sheet is the same as the deflection of the other end of the paper sheet. In this case, the turning-on or off of the attitude detector 101*a* corresponding to the one end of the paper sheet is the same as the turning-on or off of the attitude detector 101*b* corresponding to the other end of the paper sheet.

In this case, there is no concern that difference is generated between the transport distance of the other end of the paper sheet and the transport distance of one end of the paper sheet at the transport roller pair 71. Accordingly, since the reverse-rotation operation (see FIG. 10) does not need to be performed. That is, the reverse-rotation operation (see FIG. 10) may be omitted. As a result, it may be possible to shorten time between the picking-up of the paper sheet P and the beginning of the recording. Further, it may be possible to increase the number of recorded paper sheets P per unit time. That is, it may be possible to reduce throughput.

Furthermore, the attitude detectors 101*a* and 101*b* have been provided above the paper sheet P (on the same side as the recording head), but may be provided below the paper sheet (on the same side as the platen). Even in this case, it may be possible to obtain the same advantages.

A feed device of the printer 100 according to another embodiment 1 includes the attitude detectors 101*a* and 101*b* that are serve as a pair of medium attitude detectors. If the levers are in contact with the paper sheet P between the feed roller pair 96 and the transport roller pair 71 in the feed direction Y and at positions that face one and the other ends of the paper sheet P in the width direction X of the paper sheet P, the medium attitude detectors are turned on and detect the attitude of the paper sheet P. When one of the pair of the attitude detectors 101*a* and 101*b* is turned on, the controller 90 makes the second assist roller 51 and the intermediate driving roller 50 be separated from each other and rotationally drives the intermediate driving roller 50 in the reverse direction. Then, when the turning-on or off of the attitude detectors 101*a* is switched to be the same as the turning-on or off of the attitude detector 101*b*, the controller stops the reverse rotation driving of the intermediate driving roller 50.

Another Embodiment 2

Figure 15:
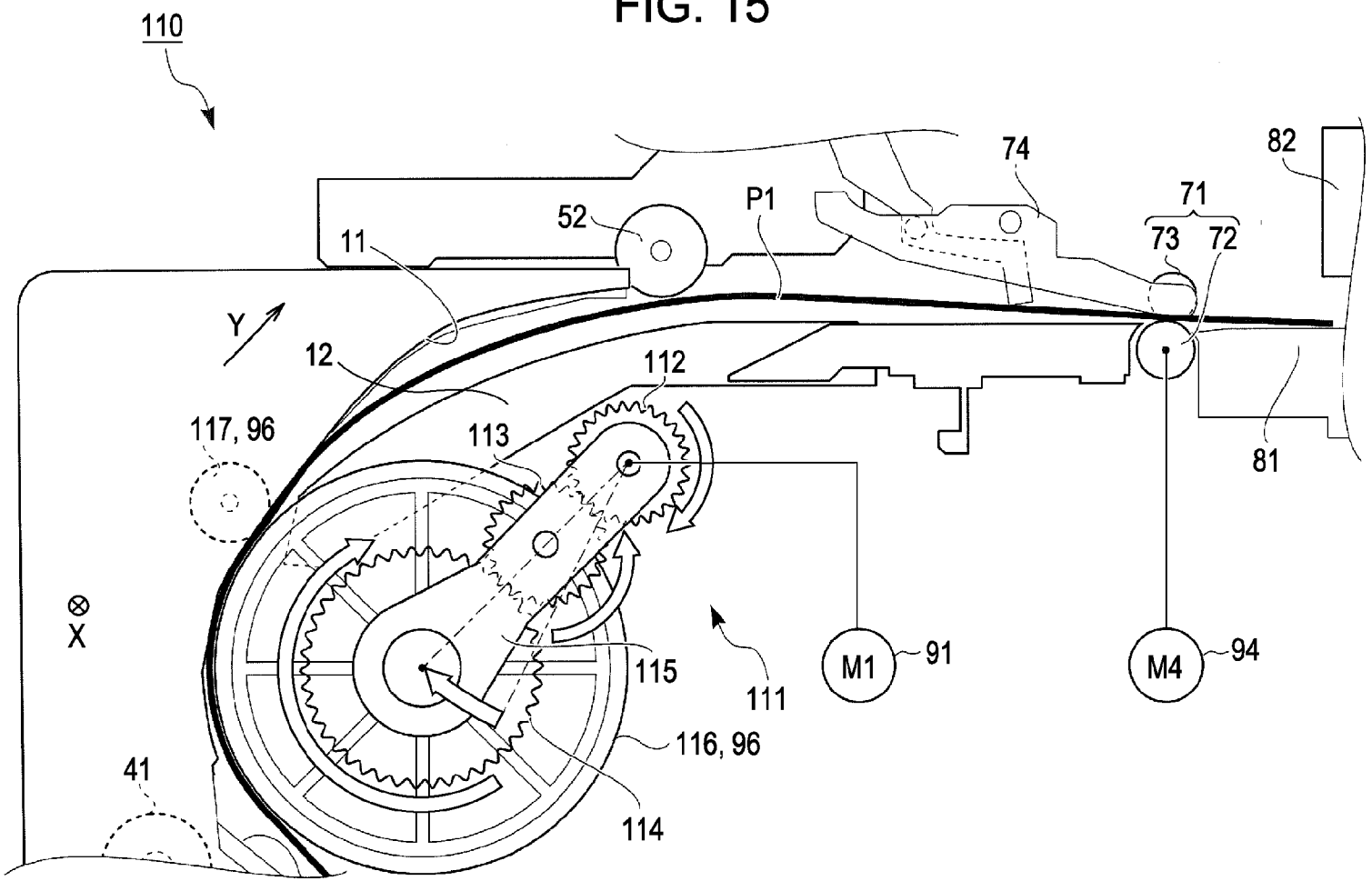
FIG. 15 is a side view illustrating that an intermediate driving roller of another embodiment 2 is rotationally driven in a normal direction.
Figure 16:
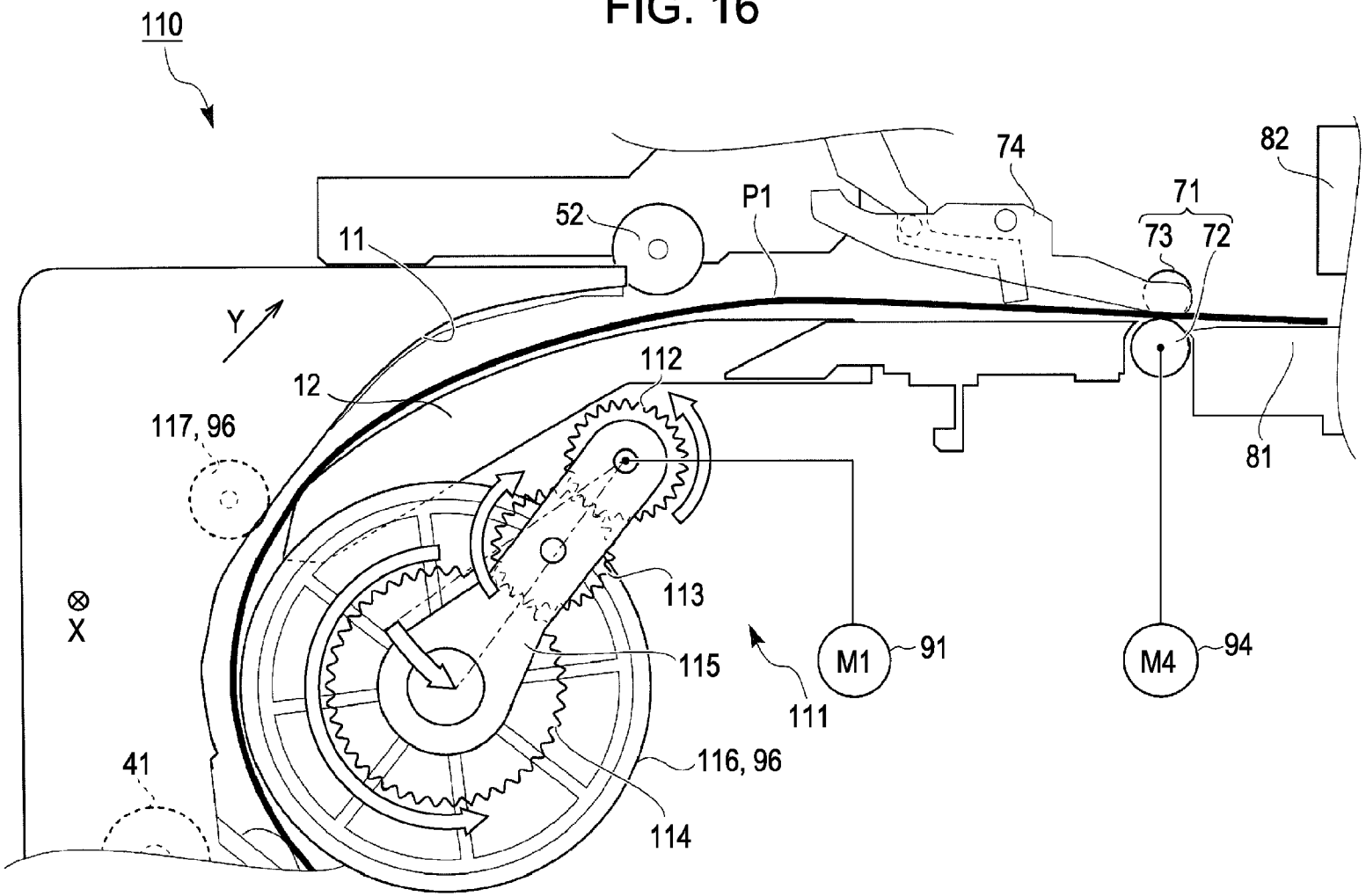
FIG. 16 is a side view illustrating that the intermediate driving roller of another embodiment 2 is rotationally driven in a reverse direction.
Figure 17:
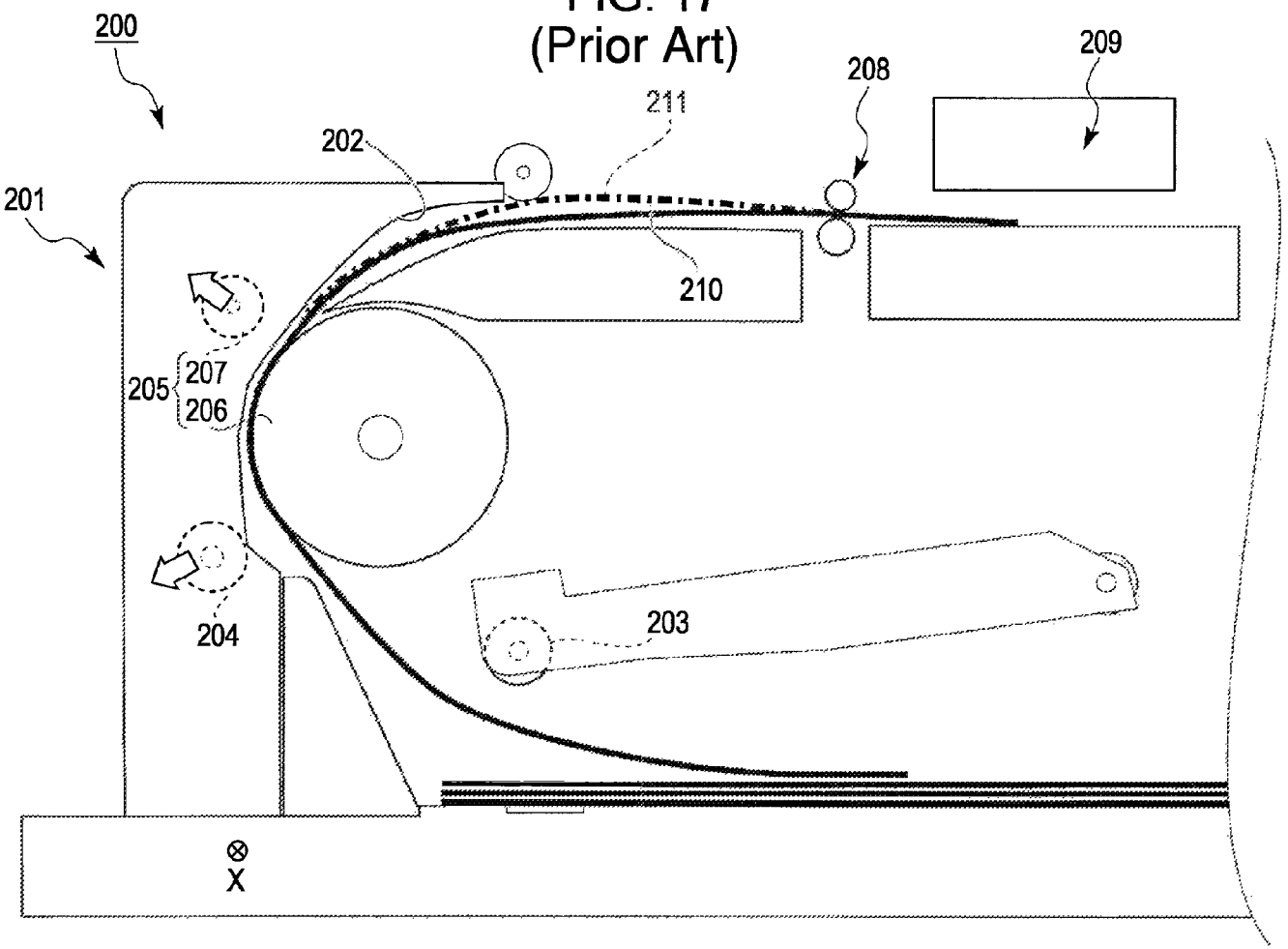
FIG. 17 (Prior Art)
FIG. 17 is a side view showing the schematic inner configuration of a recording apparatus in the related art.

FIG. 15 is a side view illustrating that an intermediate driving roller of another embodiment 2 is rotationally driven in a normal direction. FIG. 16 is a side view illustrating that the intermediate driving roller of another embodiment 2 is rotationally driven in a reverse direction.

As shown in FIGS. 15 and 16, a printer 110 according to another embodiment 2 includes a planetary gear mechanism 111. Further, an intermediate driving roller 116 is formed so as to approach or be separated from a second assist roller 117 by the planetary gear mechanism 111.

Specifically, the planetary gear mechanism 111 includes a first gear 112, a second gear 113, a third gear 114, and a gear holder 115. The first gear 112 is rotated by the power of a feeding motor 91. Further, the second gear 113 is rotatably held by the gear holder 115, is in contact with the first gear 112, and is rotated by power transmitted from the first gear 112. Furthermore, the third gear 114 is rotatably held by the gear holder 115, is in contact with the second gear 113, and is rotated by power transmitted from the second gear 113.

In addition, the intermediate driving roller 116 is rotatably held by the gear holder 115. The third gear 114 is provided to be rotated together with the intermediate driving roller 116 as a single body. The gear holder 115 is provided to swing about the center of rotation of the first gear 112. Accordingly, the second gear 113, the third gear 114, and the intermediate driving roller 116 can be moved around the first gear 112. Accordingly, the intermediate driving roller 116 may approach or be separated from the second assist roller 117.

More specifically, when the feeding motor 91 is driven in a normal direction as shown in FIG. 15, the first gear 112 is rotated clockwise in FIG. 15. Accordingly, the second gear 113 is rotated counterclockwise, and the third gear 114 and the intermediate driving roller 116 are rotated clockwise. In this case, a force for displacing the second gear clockwise is applied to the second gear 113 by the clockwise rotation of the first gear 112. Accordingly, the gear holder 115 swings clockwise. As a result, the intermediate driving roller 116 approaches the second assist roller 117. Further, the intermediate driving roller 116 and the second assist roller 117 form a feed roller pair 96, cooperate with each other, and may feed the paper sheet P1 toward the downstream side in the feed direction.

Meanwhile, when the feeding motor 91 is driven in a reverse direction as shown in FIG. 16, the first gear 112 is rotated counterclockwise in FIG. 16. Accordingly, the second gear 113 is rotated clockwise, and the third gear 114 and the intermediate driving roller 116 are rotated counterclockwise. In this case, a force for displacing the second gear counterclockwise is applied to the second gear 113 by the counterclockwise rotation of the first gear 112. Accordingly, the gear holder 115 swings counterclockwise. As a result, the intermediate driving roller 116 is separated from the second assist roller 117.

Therefore, like in the reverse-rotation operation (see FIG. 10) of the above-mentioned embodiment, while sliding between the paper sheet P1 and the periphery of the intermediate driving roller 116, the intermediate driving roller 116 may slightly apply a reverse feed force to the paper sheet P1 toward the upstream side in the feed direction. As a result, it may be possible to reduce the deflection of the paper sheet P1 that is generated between the feed roller pair 96 and the transport roller pair 71 in the feed direction Y.

In addition, it may be possible to remove the difference between the deflection of one end of the paper sheet P1 and the deflection of the other end of the paper sheet. As a result, there is no concern that difference is generated between the transport distance of the other end of the paper sheet and the transport distance of one end of the paper sheet at the transport roller pair 71 while recording is performed thereafter.

Further, in comparison with the reverse-rotation operation (see FIG. 10) of the above-mentioned embodiment, it may be possible to simultaneously begin separation and reverse rotation driving. That is, there is no concern that the timing of separation is delayed. Accordingly, since a reverse feed force is strongly applied to the feed roller pair 96, it may be possible to reliably prevent the increase of the damage of the portion of the paper sheet P1 that is nipped by the transport roller pair 71. The timing to begin the separation becomes the same as the timing to begin the reverse rotation, so that it may be possible to reduce the deterioration of throughput as much as possible.

Furthermore, if the gear holder 115 swings to approach the upstream side in the feed direction Y when the intermediate driving roller 116 is separated from the second assist roller, it may be possible to generate a reverse feed force to the paper sheet P1 toward the upstream side in the feed direction Y.

In a feed device of the printer 110 according to another embodiment 2, the intermediate driving roller 116 is provided so as to approach or be separated from the second assist roller 117 by the planetary gear mechanism 111, and the intermediate driving roller 116 is rotationally driven in the reverse direction and separated from the second assist roller 117.

Meanwhile, the invention is not limited to the above-mentioned embodiments, and may have various modifications without departing from the scope and spirit of the invention disclosed in claims. It goes without saying that these various modifications are also included within the spirit and scope of the invention.

What is claimed is:

1. A medium feeding device comprising:

a feed roller pair that includes a feed driving roller driven by power of a feeding motor and a feed driven roller to be rotationally driven, and feeds a medium to be fed toward the downstream side in a feed direction, the feed driving roller and the feed driven roller being separated from each other;

a transport roller pair that transports the medium, which is fed by the feed roller pair, toward the downstream side in the feed direction, the transport roller pair including a transport driving roller that is disposed on the downstream side of the feed roller pair in the feed direction and is driven by power of a feeding motor and a transport driven roller that is rotationally driven;

a medium guiding path section that guides the fed medium up to the transport roller pair; and a controller that makes a front end of the medium, which is a downstream end in the feed direction, be nipped by the transport roller pair by rotationally driving the transport driving roller in a downstream direction at the time of skew correction; makes the front end of the medium follow a nip line of the transport roller pair by rotationally driving the transport driving roller in an upstream direction; makes the front end of the medium be nipped by the transport roller pair by rotationally driving the transport driving roller and the feed driving roller in the downstream direction; and makes the feed driven roller and the feed driving roller be separated from each other while the transport driving roller is stopped, and rotationally drives the feed driving roller in the upstream direction.

2. The medium feeding device according to claim 1, wherein the feed driving roller is a polished rubber roller, and when the feed driving roller is rotationally driven in the upstream direction, rubber scales correspond to inverse scales.

3. The medium feeding device according to claim 1, wherein the medium guiding path section forms a U-shaped path up to the transport roller pair in side view.

4. The medium feeding device according to claim 1, further comprising:

a pickup roller that picks up a placed medium and feeds the medium toward the downstream side in the feed direction, wherein the pickup roller is separated from the placed medium when the feed driven roller and the feed driving roller are separated from each other.

5. The medium feeding device according to claim 1, further comprising:

a pair of medium attitude detectors that is turned on and detects the attitude of the medium if levers are in contact with the medium between the feed roller pair and the transport roller pair in the feed direction and at positions that face one and the other ends of the medium in a width direction of the medium, wherein the controller makes the feed driven roller and the feed driving roller be separated from each other and rotationally drives the feed driving roller in the upstream direction, when one of the pair of the medium attitude detectors is turned on, and the controller stops the upstream rotation driving of the feed driving roller when the turning-on or off of one medium attitude detectors is switched to be the same as the turning-on or off of the other one of attitude detector.

6. The medium feeding device according to claim 1, wherein the feed driving roller is provided so as to approach or be separated from the feed driven roller by a planetary gear mechanism, and the feed driving roller is rotationally driven in the upstream direction and separated from the feed driven roller.

7. A recording apparatus comprising:

a feed device that picks up a placed recording medium and feeds the recording medium toward the downstream side in a feed direction; and a recording device performs recording on the fed recording medium by a recording head, wherein the feed device includes the medium feeding device according to claim 1.

* * * * *